US007362271B2

(12) United States Patent
Iwai et al.

(10) Patent No.: US 7,362,271 B2
(45) Date of Patent: Apr. 22, 2008

(54) ANTENNA APPARATUS, COMMUNICATION APPARATUS, AND ANTENNA APPARATUS DESIGNING METHOD

(75) Inventors: Hiroshi Iwai, Kantano (JP); Atsushi Yamamoto, Osaka (JP); Kenichi Yamada, Yokohama (JP); Shinji Kamaeguchi, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/347,060

(22) Filed: Jan. 17, 2003

(65) Prior Publication Data

US 2003/0179143 A1 Sep. 25, 2003

(30) Foreign Application Priority Data

Jan. 18, 2002 (JP) ..... 2002-010572

(51) Int. Cl.
*H01Q 1/38* (2006.01)

(52) U.S. Cl. ..... 343/700 MS; 343/895

(58) Field of Classification Search ..... 343/700 MS, 343/895, 767

See application file for complete search history.

(56) References Cited

U.S. PATENT DOCUMENTS 5,568,155 A * 10/1996 Tsunekawa et al. .. 343/700 MS
5,711,013 A * 1/1998 Collett et al. ..... 455/558
5,945,954 A * 8/1999 Johnson ..... 343/700 MS
6,025,802 A * 2/2000 Eggleston et al. ... 343/700 MS
6,025,816 A * 2/2000 Dent et al. ..... 343/895
6,147,649 A * 11/2000 Ivrissimtzis et al. . 343/700 MS
6,411,826 B1 * 6/2002 Camp, Jr. ..... 455/566
6,429,818 B1 * 8/2002 Johnson et al. ..... 343/702
6,429,829 B1 * 8/2002 Hirai et al. ..... 343/895
6,452,549 B1 * 9/2002 Lo ..... 343/700 MS
6,459,916 B1 * 10/2002 Suguro ..... 343/702
6,486,834 B2 * 11/2002 Tsai ..... 343/702
6,498,586 B2 * 12/2002 Pankinaho ..... 343/700 MS
6,535,167 B2 * 3/2003 Masuda et al. ..... 343/700 MS
6,545,642 B1 * 4/2003 Doub et al. ..... 343/700 MS
6,567,053 B1 * 5/2003 Yablonovitch et al. ..... 343/700 MS
6,642,904 B2 * 11/2003 Yokoshima et al. ..... 343/829
6,765,536 B2 * 7/2004 Phillips et al. ..... 343/702

(Continued)

FOREIGN PATENT DOCUMENTS

EP 1 168 491 A1 1/2002

(Continued)

OTHER PUBLICATIONS

European Search Report for EP 03 00 0641, dated Jul. 19, 2004.

*Primary Examiner*—Wilson Lee
(74) *Attorney, Agent, or Firm*—RatnerPrestia

(57) ABSTRACT

For a PDC (Personal Digital Cellular) folding cellular phone that uses, for example, an 800-MHz band for communication, it is desirable to reduce a height of an antenna apparatus in order to reduce a thickness of the cellular phone.

An antenna apparatus including an antenna element having a feeding plate, a ground plate arranged opposite the antenna element, a short circuit section that connects the antenna element and the ground plate together, and one or more ground wires each connected to the ground plate at a predetermined position and each having a (1) linear shape or a (2) bent or curved shape.

3 Claims, 27 Drawing Sheets

U.S. PATENT DOCUMENTS

| | | | | |
|---|---|---|---|---|
| 2001/0035843 | A1* | 11/2001 | Boyle | 343/700 MS |
| 2002/0030628 | A1* | 3/2002 | Tsai | 343/702 |

FOREIGN PATENT DOCUMENTS

| | | | |
|---|---|---|---|
| JP | 58-104504 | | 6/1983 |
| JP | 62-161410 | | 10/1987 |
| JP | 2-13842 | | 4/1990 |
| JP | 08-331001 | | 12/1996 |
| JP | 10-256819 | | 9/1998 |
| JP | 2001-217641 | A | 8/2001 |
| JP | 2002-009520 | A | 1/2002 |
| JP | 2002-009521 | A | 1/2002 |
| WO | WO99/54956 | | 10/1999 |

* cited by examiner

ANTENNA APPARATUS, COMMUNICATION APPARATUS, AND ANTENNA APPARATUS DESIGNING METHOD

BACKGROUND OF THE INVENTION

1. Field of the Invention

The present invention relates to an antenna apparatus and a communication apparatus which are used in, for example, cellular phones as well as an antenna apparatus designing method.

2. Related Art of the Invention

First, a configuration and operation of a conventional inverted F antenna (see, for example, the specification of Japanese Patent NO. 1685741, Japanese Examined Patent Application Publication No. H2-13842) will be described mainly with reference to FIG. 13, a perspective view of the conventional inverted F antenna and FIG. 14, its plan view.

The entire disclosure of the document "the specification of Japanese Patent NO. 1685741 (Japanese Examined Patent Application Publication No. H2-13842)" is incorporated herein by reference in its entirety.

The conventional inverted F antenna comprises an antenna element 110 having a feeding plate 111 to which electricity is fed from a feeding point 112, a ground plate 120 arranged opposite the antenna element 110, and a short circuit plate 130 that electrically connects the antenna element 110 and the ground plate 120 together.

The ground plate 120 has a generally rectangular shape in which long sides are each 165 mm in length (length), while short sides are each 44 mm in length (width) (see FIG. 14).

The ground plate 120 has a length of 165 mm, a numerical value which substantially equals the overall length of a folding cellular phone as opened and which corresponds to $\lambda/2$, i.e. half of a wavelength $\lambda$ in a 900-MHz band. Further, the distance between the antenna element 110 and the ground plate 120, H=4 mm (see FIG. 13) is an example of a numeral value required as the height of an antenna incorporated in a folding cellular phone the thickness of which tends to be significantly reduced.

Such a conventional inverted F antenna has such impedance characteristics as shown in FIG. 15(*a*), a Smith chart illustrating the characteristics of impedance of inputs in view of the antenna from the feeding point of the conventional inverted F antenna (d=13 mm) and in FIG. 15(*b*) illustrating its VSWR (Voltage Standing Wave Ratio).

However, the above described conventional inverted F antenna has no frequency range within which VSWR$\leqq$2 (see FIG. 15(*b*)) and thus fails to accomplish so called 50-Ω matching. Accordingly, this antenna is very unsuitable for practical use.

Of course, by reducing the distance d between the feeding plate 111 and the short circuit plate 130, it is possible to obtain such impedance characteristics as shown in FIG. 16(*a*). FIG. 16(*a*) is a Smith chart illustrating the characteristics of impedance of inputs in view of the antenna from the feeding point of the conventional inverted F antenna (d=2 mm) and in FIG. 16(*b*) illustrating its VSWR (Voltage Standing Wave Ratio). However, if d=2 mm, resonance frequency is 839 MHz and the frequency range within which VSWR$\leqq$2 is between 799 and 872 MHz and hence bandwidth is only 73 MHz. Thus, the specific band obtained by dividing the bandwidth by central frequency is only 8.7%. Accordingly, even if such an inverted F antenna is incorporated in PDC (Personal Digital Cellular) communication equipment that uses, for example, an 800-MHz band for communication, a specific band of 17% or more, required for communication based on this method, is not achieved. Consequently, it is difficult for this antenna to fully cover transmissions and receptions.

SUMMARY OF THE INVENTION

In view of these prior art problems, it is an object of the present invention to provide an antenna apparatus, a communication apparatus, and an antenna apparatus designing method that enable the thickness of folding cellular phones to be reduced, for example.

The 1st aspect of the present invention is an antenna apparatus comprising:

an antenna element having a feeding section;

a ground plate arranged opposite said antenna element;

a short circuit section that connects said antenna element and said ground plate together; and one or more ground wires each connected to said ground plate at a predetermined position and each having (1) a linear shape or (2) a bent or curved shape.

The 2nd aspect of the present invention is an antenna apparatus comprising:

an antenna element having a feeding section;

a ground plate arranged opposite said antenna element and having a generally rectangular shape with short sides and long sides;

a short circuit section that connects said antenna element and said ground plate together; and one or more ground wires each connected to said ground plate at a predetermined position and each having a predetermined shape, and wherein said antenna element is arranged on the side of one of said short sides, and all or part of said ground wires are each connected to a corner of said ground plate which is located on the side of said antenna element, and each have a generally spiral shape the width of which is equal to or smaller than the length of said short side and which is formed outside the short side on the side of said antenna element.

The 3rd aspect of the present invention is an antenna apparatus comprising:

an antenna element having a feeding section;

a ground plate arranged opposite said antenna element and having a generally rectangular shape with short sides and long sides;

a short circuit section that connects said antenna element and said ground plate together; and one or more ground wires each connected to said ground plate at a predetermined position and each having a predetermined shape, and wherein said antenna element is arranged on the side of one of said short sides, and all or part of said ground wires each have a foot portion extending along the long sides of said ground plate and connected to the middle of one of said long sides and each have a generally spiral shape the width of which is equal to or smaller than the length of said short side and which is formed outside the short side on the side of said antenna element.

The 4th aspect of the present invention is the antenna apparatus, wherein said ground wire is at least partly located in a plane different from a plane in which said ground plate is located.

The 5th aspect of the present invention is the antenna apparatus, wherein said antenna apparatus is used for cellular phone, and when said ground wire is located in a plane different from the plane in which said ground plate (120') is located, said ground wire is located further from a user's head when said user uses said cellular phone.

The 6th aspect of the present invention is the antenna apparatus, wherein said ground wire is also used as a ground electrode.

The 7th aspect of the present invention is the antenna apparatus, wherein said antenna apparatus is used for a cellular phone having a camera and/or a receiver, and said ground electrode is used in said camera and/or said receiver.

The 8th aspect of the present invention is the antenna apparatus, wherein said ground wire is constructed as a member different from said ground plate.

The 9th aspect of the present invention is the antenna apparatus, wherein said antenna apparatus is used in a cellular phone having an enclosure, and when said ground wire is constructed as a member different from said ground plate, said ground wire is constructed as a member stuck to an inner wall portion of said enclosure.

The 10th aspect of the present invention is the antenna apparatus, wherein at least part of said ground wire is not opposite said antenna element.

The 11th aspect of the present invention is the antenna apparatus, wherein said short circuit sections each have a plurality of short circuit pins corresponding to predetermined operating frequencies, respectively, and said antenna apparatus further comprises a switch circuit used to carry out switching to one of said plurality of short circuit pins which is to be used.

The 12th aspect of the present invention is the antenna apparatus, wherein said antenna element has a predetermined slit (S).

The 13th aspect of the present invention is the antenna apparatus, wherein said ground wire partly has a coil (L1) and/or a capacitor (C1).

The 14th aspect of the present invention is the antenna apparatus, wherein said coil (L1) and/or said capacitor (C1) is used to equivalently adjust the electric length of said ground wire.

The 15th aspect of the present invention is the antenna apparatus, wherein a plurality of said ground wires are provided, and said ground wires correspond to respective predetermined operating frequencies.

The 16th aspect of the present invention is the antenna apparatus, wherein said ground wire has a helical shape.

The 17th aspect of the present invention is a the communication apparatus comprising:

an antenna apparatus;

transmission means of transmitting electric wave signals using said antenna apparatus; and reception means of receiving electric wave signals using said antenna apparatus.

The 18th aspect of the present invention is the communication apparatus, wherein said antenna apparatus is used in a cellular phone, and said communication apparatus further comprises a first enclosure that houses said antenna apparatus, a second enclosure that is different from said first enclosure, and a hinge section that joins said first enclosure and said second enclosure together.

a predetermined antenna apparatus, a first enclosure that houses said antenna apparatus and a predetermined substrate, a second enclosure that is different from said first enclosure , and a hinge section that joins said first enclosure and said second enclosure together, and wherein a ground of said substrate and said hinge section are electrically connected together.

The 20th aspect of the present invention is the communication apparatus, wherein said electric connection is such that one end of said hinge section is connected to a ground of said substrate, with the other end open.

The 21st aspect of the present invention is an antenna apparatus designing method for the antenna apparatus, wherein said predetermined positions and/or said predetermined shapes are adjusted on the basis of predetermined rules.

The 22nd aspect of the present invention is the antenna apparatus designing method, wherein said ground wire partly has a coil (L1) and/or a capacitor (C1), and said coil (L1) and/or said capacitor (C1) is used to equivalently adjust the electric length of said ground wire.

DESCRIPTION OF SYMBOLS

Figure 1:
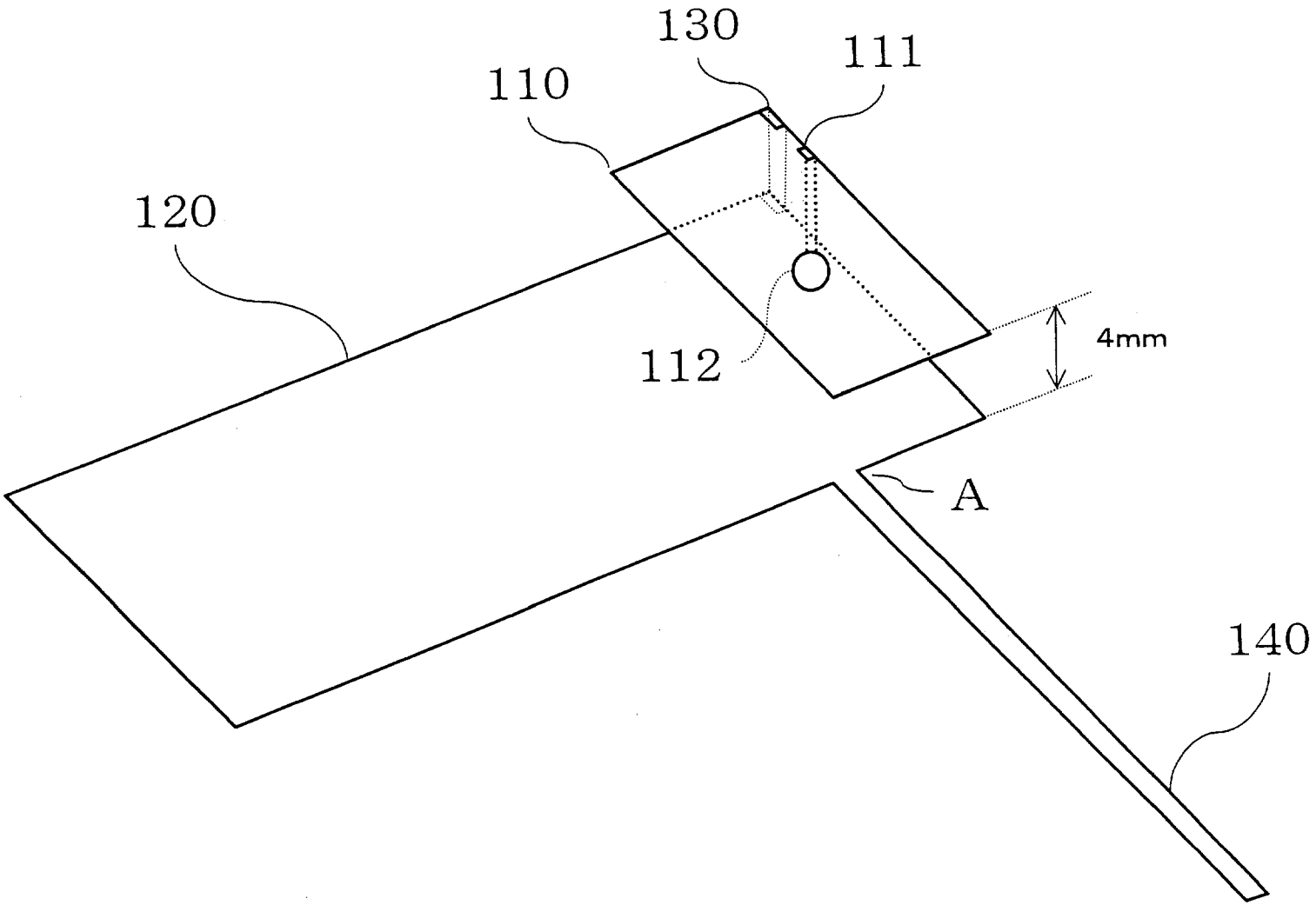
FIG. 1 is a perspective view of an inverted F antenna of Embodiment 1 of the present invention.

110 Antenna element
111 Feeding plate
112 Feeding point
120 Ground plate
130 Short circuit plate
140 Ground wire

PREFERRED EMBODIMENTS OF THE INVENTION

Embodiments of the present invention will be described below with reference to the drawings.

(Embodiment 1)

Mainly with reference to FIG. 1, a perspective view of the inverted F antenna of Embodiment 1 of the present invention, description will be given of a configuration of an inverted F antenna of the present embodiment.

The inverted F antenna of the present embodiment comprises an antenna element 110 having a feeding plate 111 to which electricity is fed from a feeding point 112, a ground plate 120 arranged opposite the antenna element 110, a short circuit plate 130 that electrically connects the antenna element 110 and the ground plate 120 together, and a ground wire 140 connected to the ground plate 120 at a predetermined position A and having a linear shape.

For example, in one embodiment, the antenna element 110 corresponds to an antenna element of the present invention. The feeding plate 111 corresponds to a feeding section of the present invention. The ground plate 120 corresponds to a ground plate of the present invention. The short circuit plate 130 corresponds to a short circuit section of the present invention. The ground wire 140 corresponds to a ground wire of the present invention. Further, the inverted F antenna of the present invention corresponds to an antenna apparatus of the present invention.

The inverted F antenna of the present embodiment has a relatively small height (that is, the distance between the antenna element 110 and the ground plate 120) of about 4 mm and can thus be incorporated adequately in a thin folding cellular phone.

Figure 2:
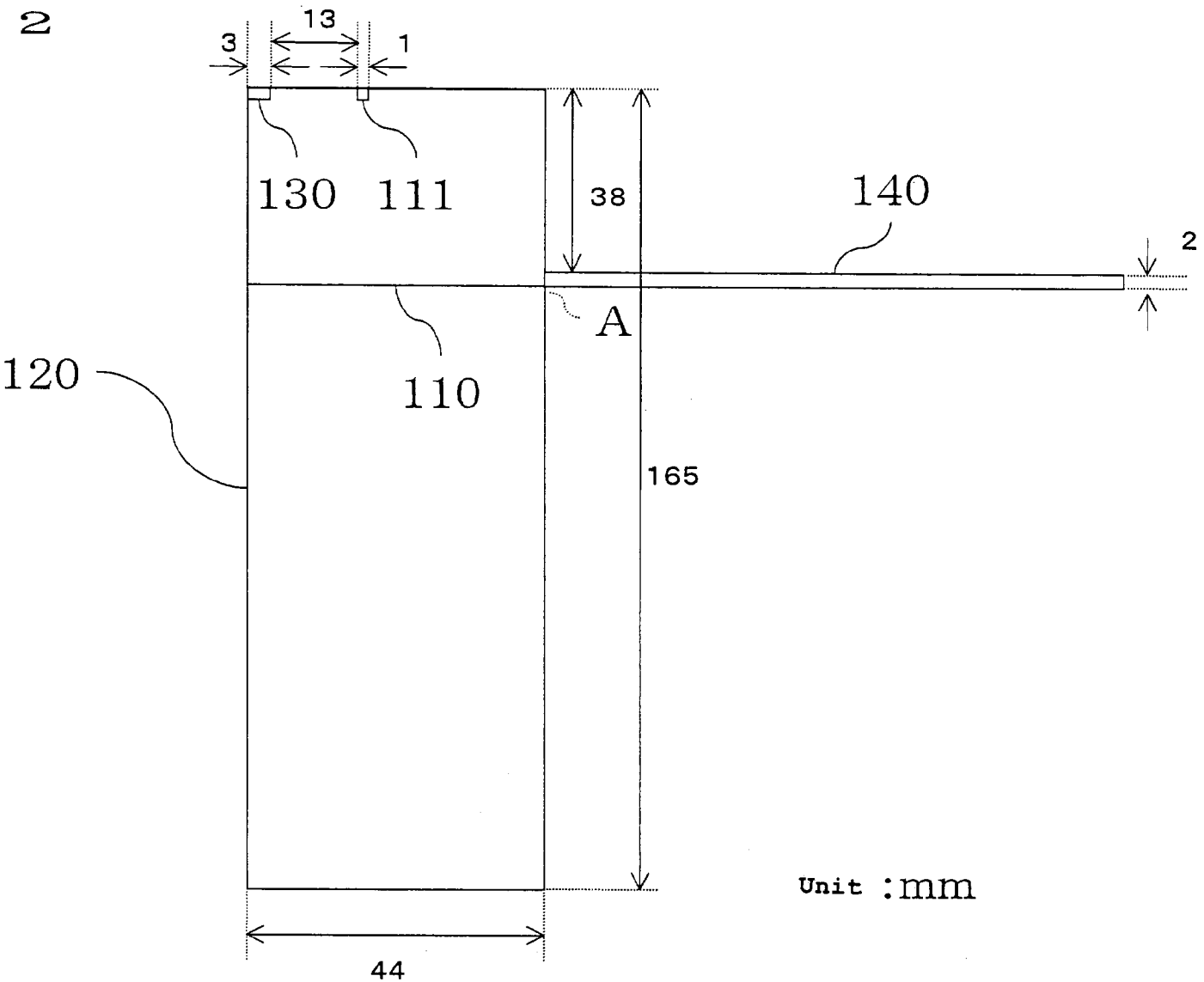
FIG. 2 is a plan view of the inverted F antenna of Embodiment 1 of the present invention.

Then, mainly with reference to FIG. 2, a plan view of the inverted F antenna of Embodiment 1 of the present invention, detailed description will be given of the configuration of the inverted F antenna of the present embodiment.

The ground plate 120 is composed of a conductive material such as copper, and has a generally rectangular shape in which long sides are each about 165 mm in length (length), while short sides are each about 44 mm in length (width). As described previously, the ground plate 120 has a length of about 165 mm, a numerical value which substantially equals the overall length of a folding cellular phone as opened and which corresponds to $\lambda/2$, i.e. half of a wavelength $\lambda$ in a 900-MHz band.

The antenna element 110 is composed of a conductive material such as copper, and has a generally rectangular shape having a length of about 40 mm and a width of about 44 mm. The antenna element 110 is arranged over one of the short sides of the ground plate 120.

The feeding plate 111 is composed of copper, conductive material, and has a planar shape having a width of 1 mm. The feeding plate 111 is electrically connected to the antenna element 110.

The short circuit plate 130 is composed of copper, conductive material, and has a planar shape having a width of about 3 mm. The short circuit plate 130 is electrically connected to the ground plate 120 and the antenna element 110.

In this case, the distance between the feeding plate 111 and the short circuit plate 130 is about 13 mm.

The ground wire 140 is composed of copper, conductive material, and has a linear shape having a length of about 90 mm and a width of about 2 mm. The ground wire 140 is connected to the ground plate 120 at a predetermined position A, about 38 mm away from that short side of the ground plate 120 which is located under the antenna element 110.

Figure 13:
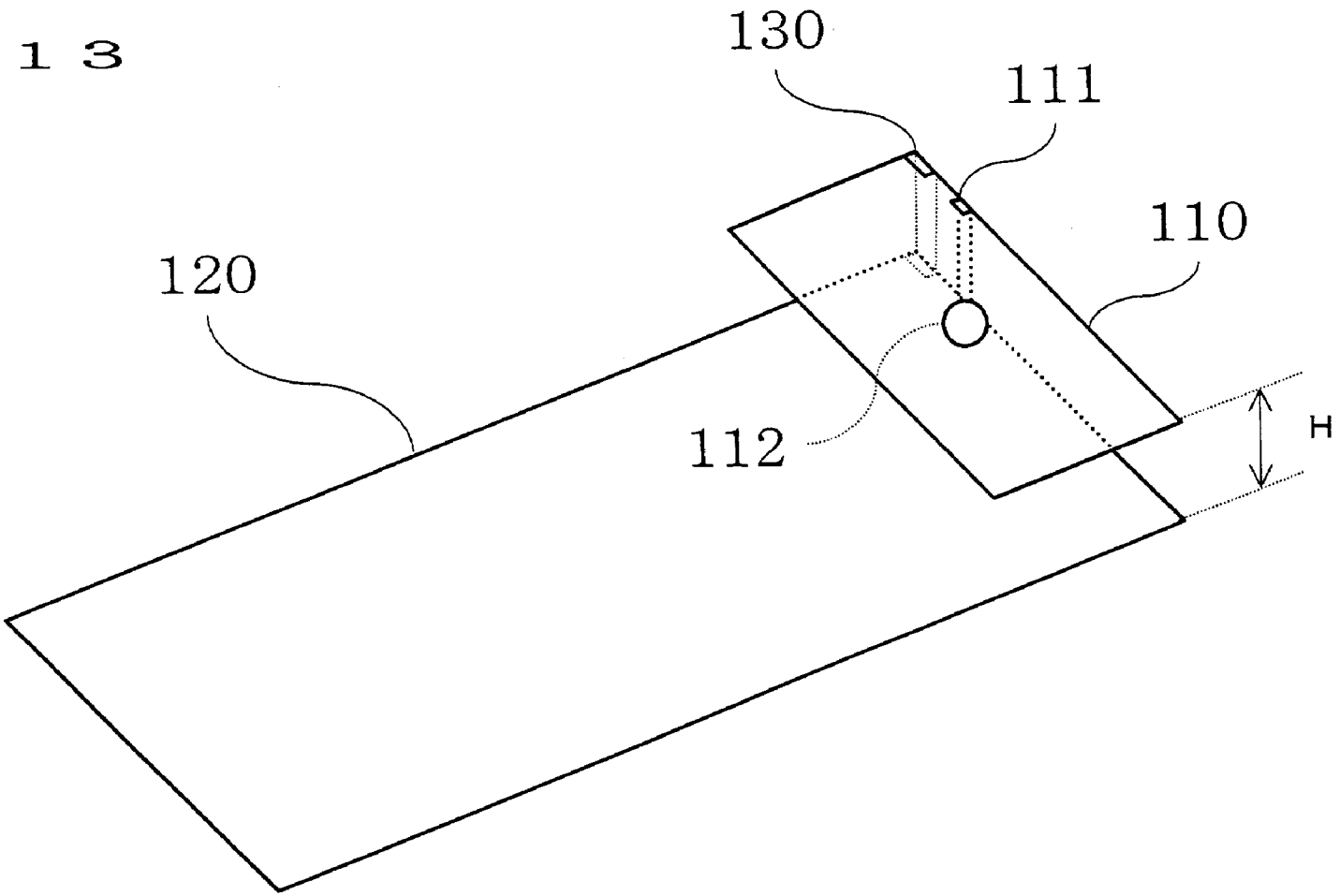
FIG. 13 is a perspective view of a conventional inverted F antenna.
Figure 14:
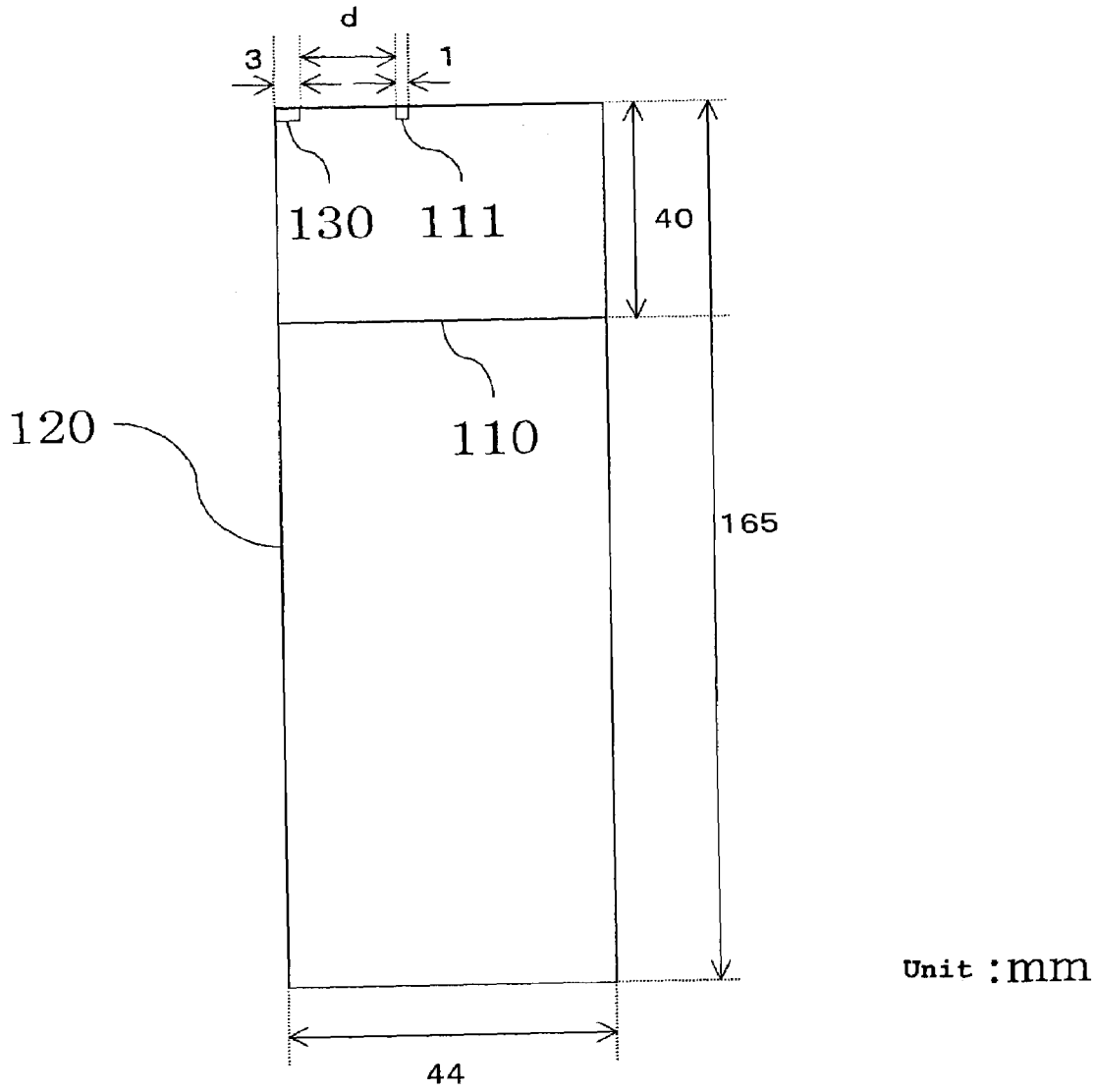
FIG. 14 is a plan view of the conventional inverted F antenna.
Figure 15A:
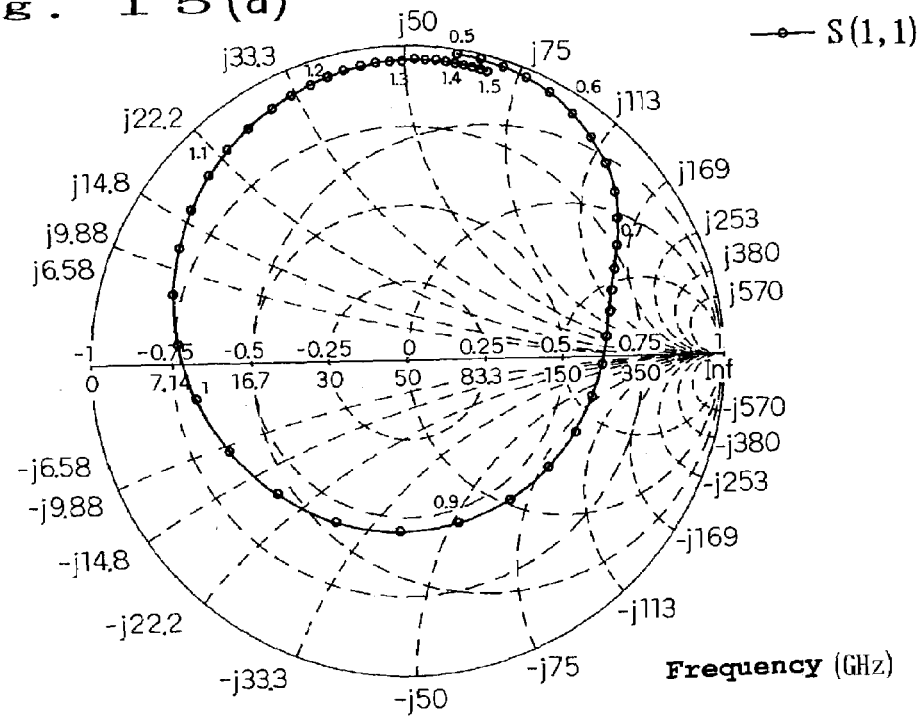
FIG. 15(*a*) is a Smith chart illustrating the characteristics of impedance of inputs in view of the antenna from a feeding point of a conventional inverted F antenna (d=13 mm), and FIG. 15(*b*) is a chart illustrating the VSWR (Voltage Standing Wave Ratio) of this antenna.
Figure 15B:
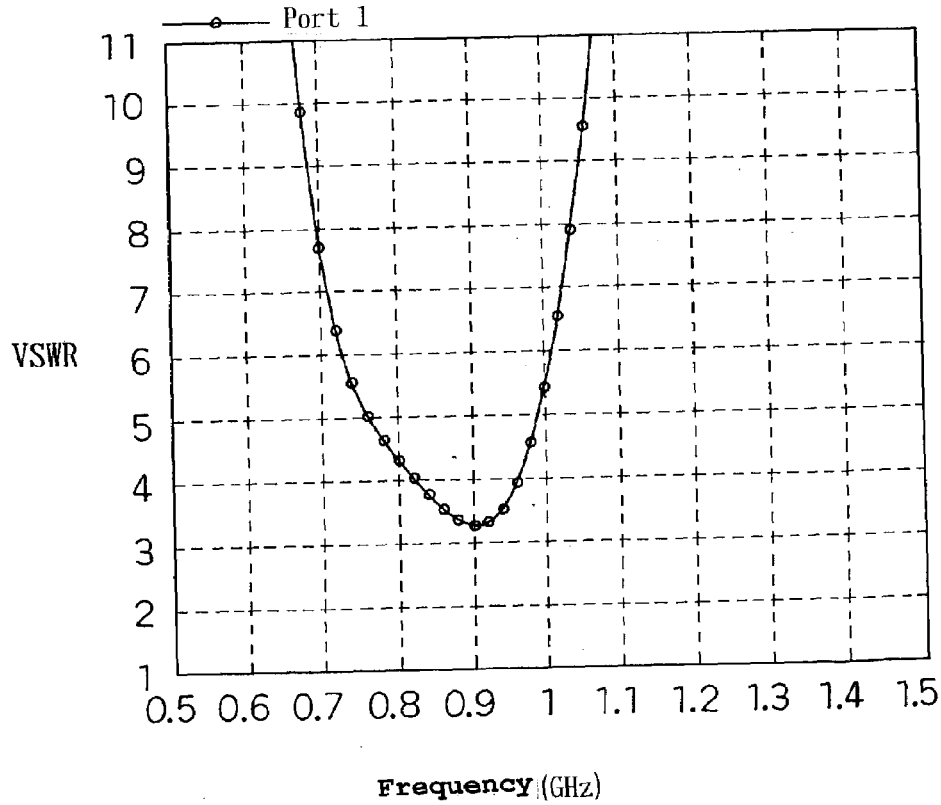
Figure 16A:
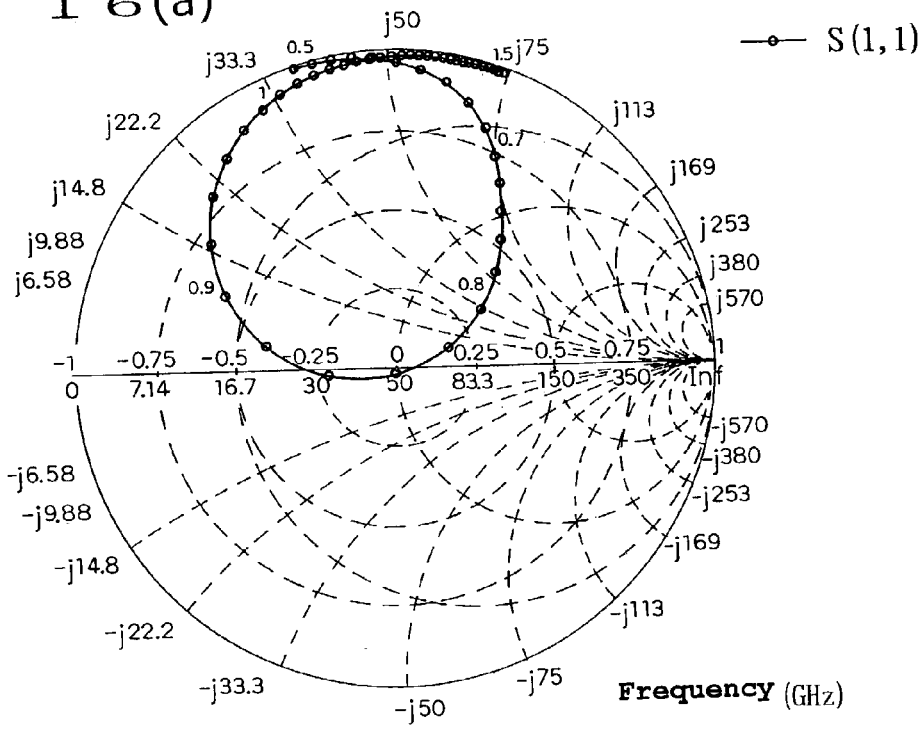
FIG. 16(*a*) is a Smith chart illustrating the characteristics of impedance of inputs in view of the antenna from a feeding point of a conventional inverted F antenna (d=2 mm), and FIG. 16(*b*) is a chart illustrating the VSWR (Voltage Standing Wave Ratio) of this antenna.
Figure 16B:
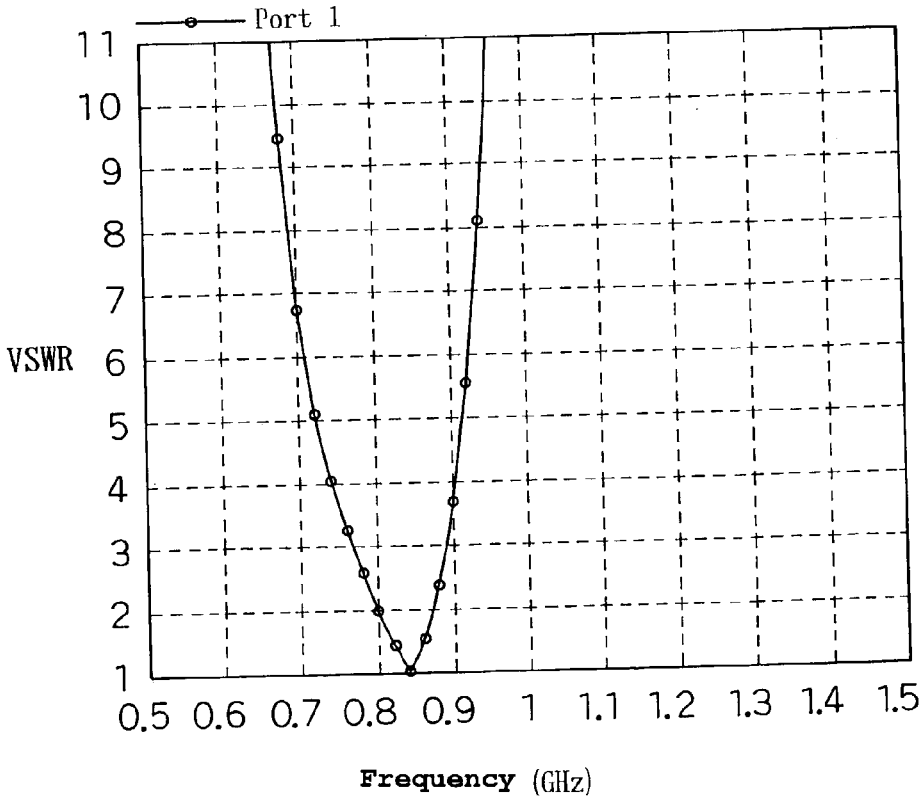

Thus, the inverted F antenna of the present embodiment has a configuration similar to that of the previously described conventional inverted F antenna (see FIGS. 13 and 14) but is characterized by comprising the ground wire 140 connected to the ground plate 120 at the predetermined position A and having the linear shape.

Now, operations of the inverted F antenna of the present embodiment will be described mainly with reference to FIG.

Figure 3A:
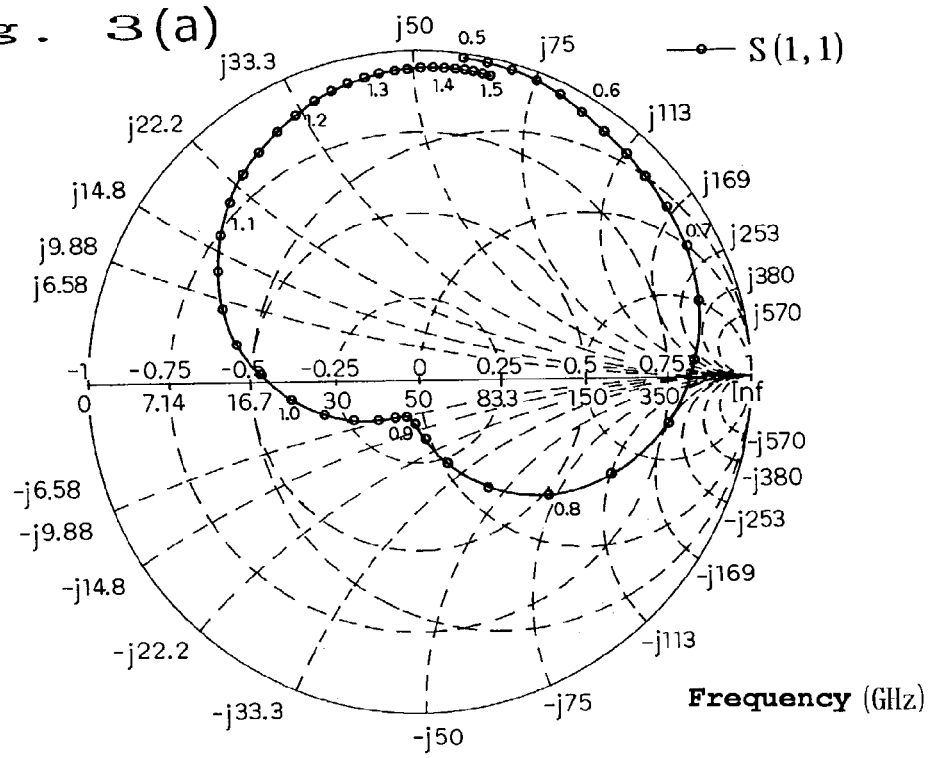
FIG. 3(*a*) is a Smith chart illustrating the characteristics of impedance of inputs in view of the antenna from a feeding point of the inverted F antenna of Embodiment 1 of the present invention, and FIG. 3(*b*) is a chart illustrating a VSWR (Voltage Standing Wave Ratio) of this antenna.
Figure 3B:
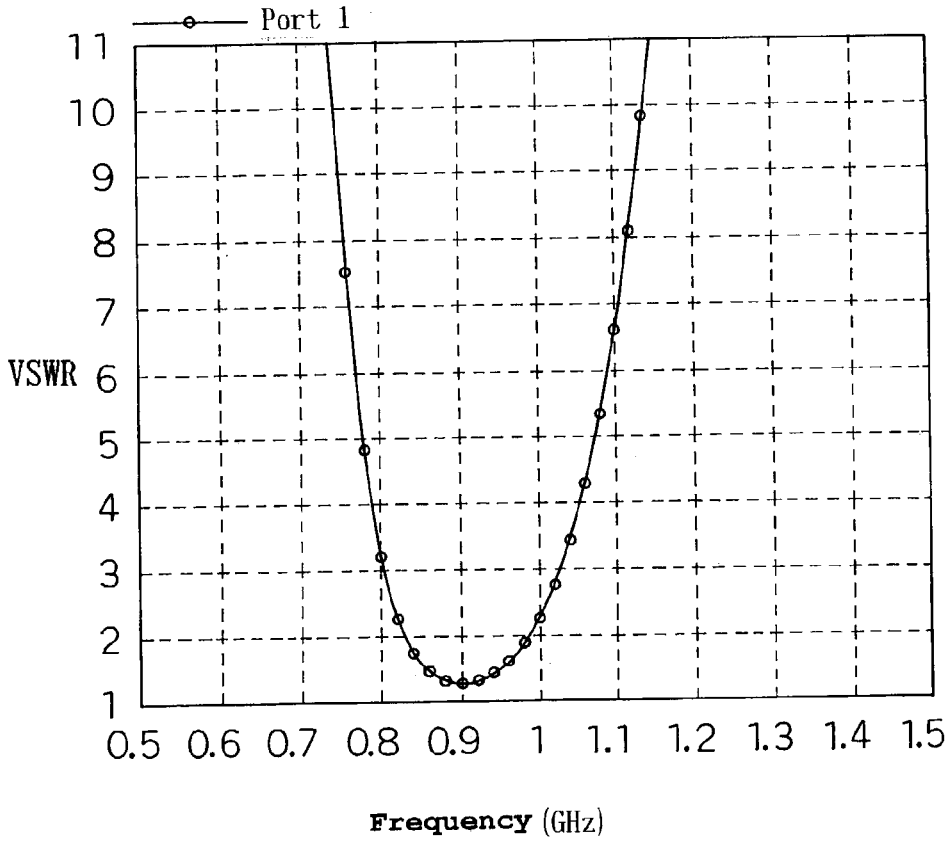

3(*a*), a Smith chart illustrating the characteristics of impedance of inputs in view of the antenna from the feeding point of the inverted F antenna of Embodiment 1 of the present invention and to FIG. 3(*b*) illustrating its VSWR (Voltage Standing Wave Ratio).

Electricity was fed from the feeding point 112 to operate the inverted F antenna of the present embodiment, and the antenna was measured in terms of frequency characteristics. Then, very good frequency characteristics were obtained as shown in FIGS. 3(*a*) and 3(*b*).

Specifically, the inverted F antenna of the present embodiment has a resonant frequency of 900 MHz and a corresponding VSWR of about 1.28. Further, the frequency range within which VSWR≦2 is between about 829 and 987 MHz. Consequently, the inverted F antenna of the present embodiment has a large bandwidth of about 158 MHz and a specific band of 17.4%, which is double that in the prior art (as described previously, the specific band required for PDC communication is 17% or more).

The Smith chart for the inverted F antenna of the present embodiment contains inflection points (see FIG. 3(*a*)). This means that there is double resonance between the antenna element 110 (see FIG. 1) and the ground plate 120 (see FIG. 1). That is, the ground wire 140 serves to fix the phase and amplitude of a particular portion of the ground plate 120, while changing the electric length of the ground plate 120. Accordingly, the resonant frequency of the antenna element 110 is close to the resonant frequency of the ground plate 120. This allows wide-band characteristics to be realized.

In the present embodiment, the ground plate 120 is too large to resonate at a desired frequency. Accordingly, the ground wire 140 is used to equivalently reduce the electric length of the ground plate 120. However, the present invention is not limited to this aspect. If the ground plate is too small to resonate at a desired frequency, the ground wire 140 may be used to equivalently increase the electric length of the ground plate 120.

Of course, the above described dimensions according to the present embodiment are only illustrative. The present invention is not limited to these dimensions (this applies to the embodiments described below).

(Embodiment 2)

Figure 4:
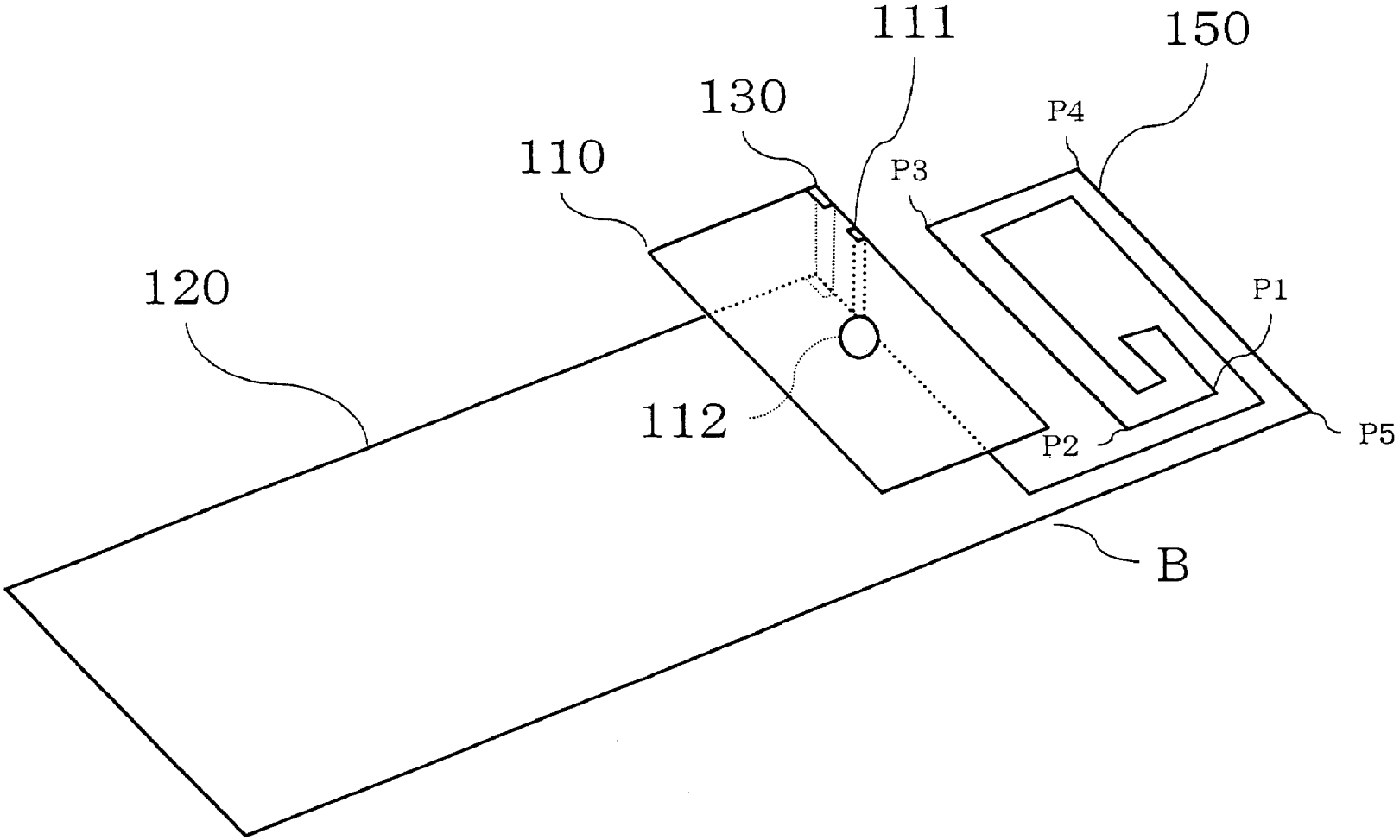
FIG. 4 is a perspective view of an inverted F antenna of Embodiment 2 of the present invention.

Now, with reference to FIG. 4, a perspective view of an inverted F antenna of Embodiment 2 of the present invention, description will be given of a configuration of the inverted F antenna of the present embodiment.

The inverted F antenna of the present embodiment comprises the antenna element 110 having the feeding plate 111, the ground plate 120 arranged opposite the antenna element 110, the short circuit plate 130 that electrically connects the antenna element 110 and the ground plate 120 together, and a ground wire 150 connected to the ground plate 120 at a predetermined position B and having a generally spiral shape with a bent portion.

The ground wire 150 corresponds to a ground wire of the present invention.

Figure 5:
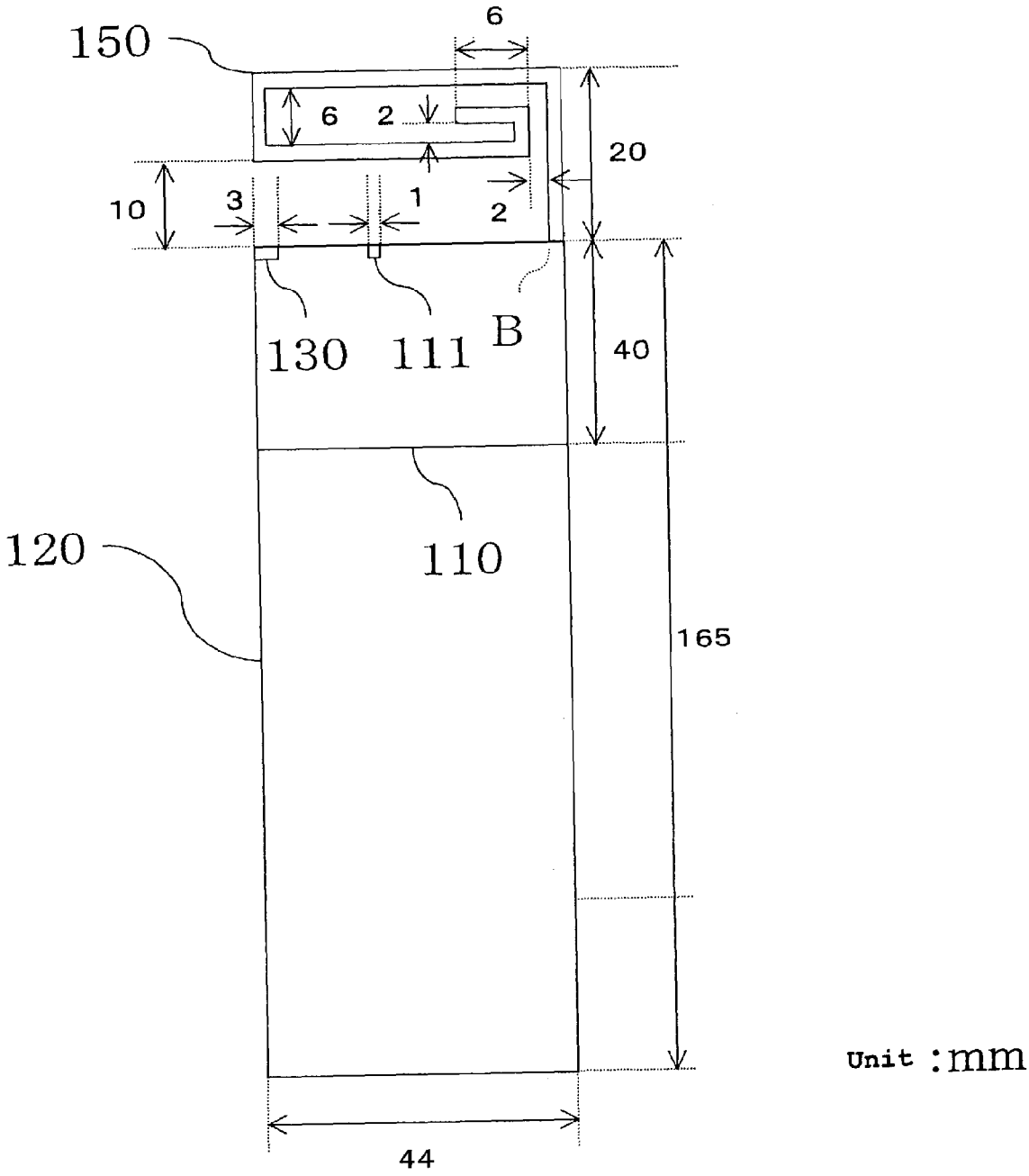
FIG. 5 is a plan view of the inverted F antenna of Embodiment 2 of the present invention.

Then, mainly with reference to FIG. 5, a plan view of the inverted F antenna of Embodiment 2 of the present invention, detailed description will be given of the configuration of the inverted F antenna of the present embodiment.

The ground wire 150 is composed of copper, conductive material, and is connected to the ground plate 120 at a predetermined position B corresponding to a corner of the ground plate 120 located under the antenna element 110. The ground wire 150 has a generally spiral shape of linear width of about 2 mm which is as large as the width of the ground plate 120 on its short side, the generally spiral shape being formed outside that short side of the ground plate 120 which is located under the antenna element 110, so as not to lie opposite the antenna element 110.

Thus, the inverted F antenna of the present embodiment has a configuration similar to that of the inverted F antenna of Embodiment 1, described previously (see FIGS. 1 and 2), but is characterized by comprising the ground wire 150 connected to the ground plate 120 at the predetermined position B and having the generally spiral shape with the bent portion.

Now, further detailed description will be given of the generally spiral shape with the bent portion according to the present embodiment.

The ground wire 150 has a first to fifth bending points P1 to P5 each bent at a right angle. It is assumed that the bending points are sequentially numbered starting with the one closest to the tip of the ground wire 150 (accordingly, the fifth bending point P5 is close to the predetermined point B, corresponding to the root of the ground wire 150).

The length between the tip of the ground wire 150 and the first bending point P1 is about 6 mm. The length between the first bending point P1 and the second bending point P2 is about 6 mm. The length between the second bending point P2 and the third bending point P3 is about 40 mm. The length between the third bending point P3 and the fourth bending point P4 is about 10 mm. The length between the fourth bending point P4 and the fifth bending point P5 is about 44 mm. The length between the fifth bending point P5 and the root of the ground wire 160 is about 20 mm.

The portion between the tip of the ground wire 150 and the first bending point P1, the portion between the second bending point P2 and the third bending point P3, and the portion between the fourth bending point P4 and the fifth bending point P5 are substantially parallel with the short sides of the ground plate 120. The spacing between the portion between the tip of the ground wire 150 and the first bending point P1 and the portion between the second bending point P2 and the third bending point P3 is about 2 mm. Further, the spacing between the portion between the second bending point P2 and the third bending point P3 and the portion between the fourth bending point P4 and the fifth bending point P5 is about 2 mm.

Further, the portion between the first bending point P1 and the second bending point P2, the portion between the third bending point P3 and the fourth bending point P4, and the portion between the fifth bending point P5 and the root of the ground wire 160 are substantially parallel with the long sides of the ground plate 120. The spacing between the portion between the first bending point P1 and the second bending point P2 and the portion between the third bending point P3 and the fourth bending point P4 is about 36 mm. Further, the spacing between the portion between the third bending point P3 and the fourth bending point P4 and the portion between the fifth bending point P5 and the root of the ground wire 160 is about 40 mm.

Now, operations of the inverted F antenna of the present embodiment will be described mainly with reference to FIG. 6(*a*), a Smith chart illustrating the characteristics of impedance of inputs in view of the antenna from the feeding point of the inverted F antenna of Embodiment 2 of the present invention and to FIG. 6(*b*) illustrating its VSWR (Voltage Standing Wave Ratio).

Electricity was fed from the feeding point 112 to operate the inverted F antenna of the present embodiment, and the antenna was measured in terms of frequency characteristics.

Figure 6:
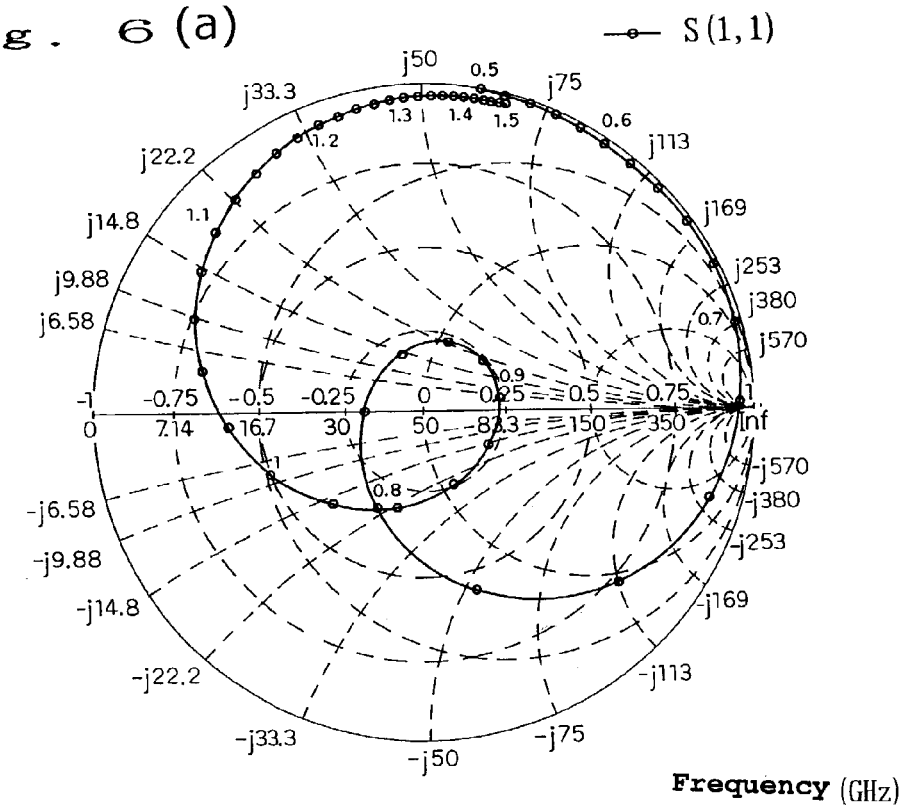
FIG. 6(*a*) is a Smith chart illustrating the characteristics of impedance of inputs in view of the antenna from a feeding point of the inverted F antenna of Embodiment 2 of the present invention, and FIG. 6(*b*) is a chart illustrating the VSWR (Voltage Standing Wave Ratio) of this antenna.
Figure 6:
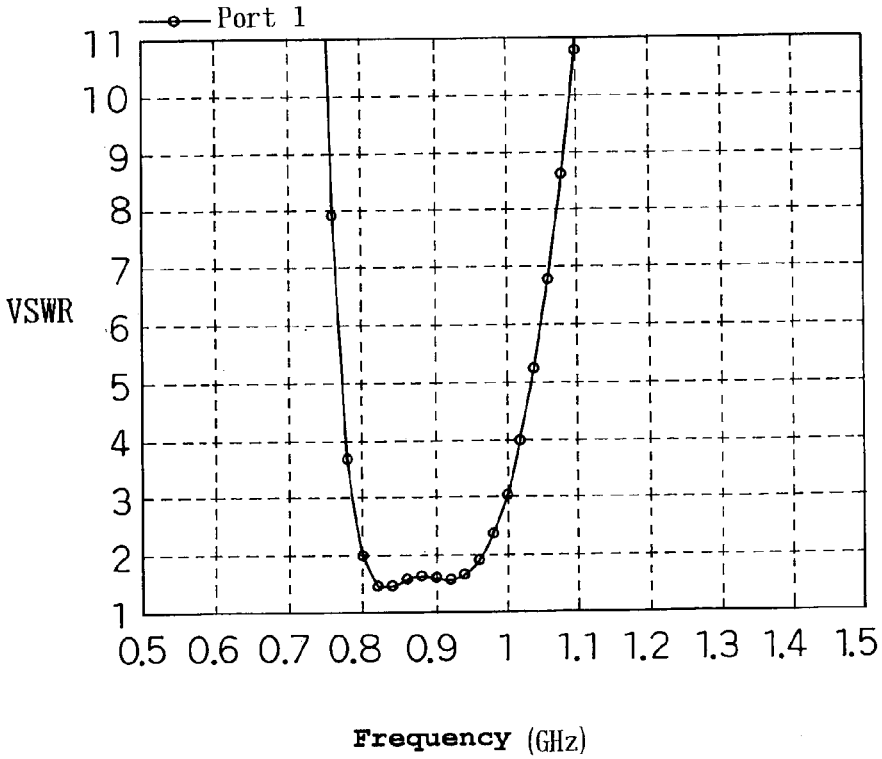

Then, very good frequency characteristics were obtained as shown in FIGS. 6(*a*) and 6(*b*).

Specifically, with the inverted F antenna of the present embodiment, the frequency range within which VSWR≦2 is between 800 and 965 MHz. Consequently, the inverted F antenna of the present embodiment has a large bandwidth of about 165 MHz and a specific band of 18.7%, which is larger than that in Embodiment 1, described previously.

The shape of the ground wire 150 having the bent portion prevents the antenna from being massive and enables a small space to be effectively utilized. Furthermore, currents flow through the ground wire 150 in the opposite directions to balance a current in a distant field. Consequently, this embodiment is expected to produce an effect besides those described previously in Embodiment 1. That is, a radiation pattern is not disturbed.

As with Embodiment 1, described previously, in the present embodiment, the ground plate 120 is too large to resonate at a desired frequency. Accordingly, the ground wire 150 is used to equivalently reduce the electric length of the ground plate 120. However, the present invention is not limited to this aspect. If the ground plate is too small to resonate at a desired frequency, the ground wire 150 may be used to equivalently increase the electric length of the ground plate 120.

(Embodiment 3)

Figure 7:
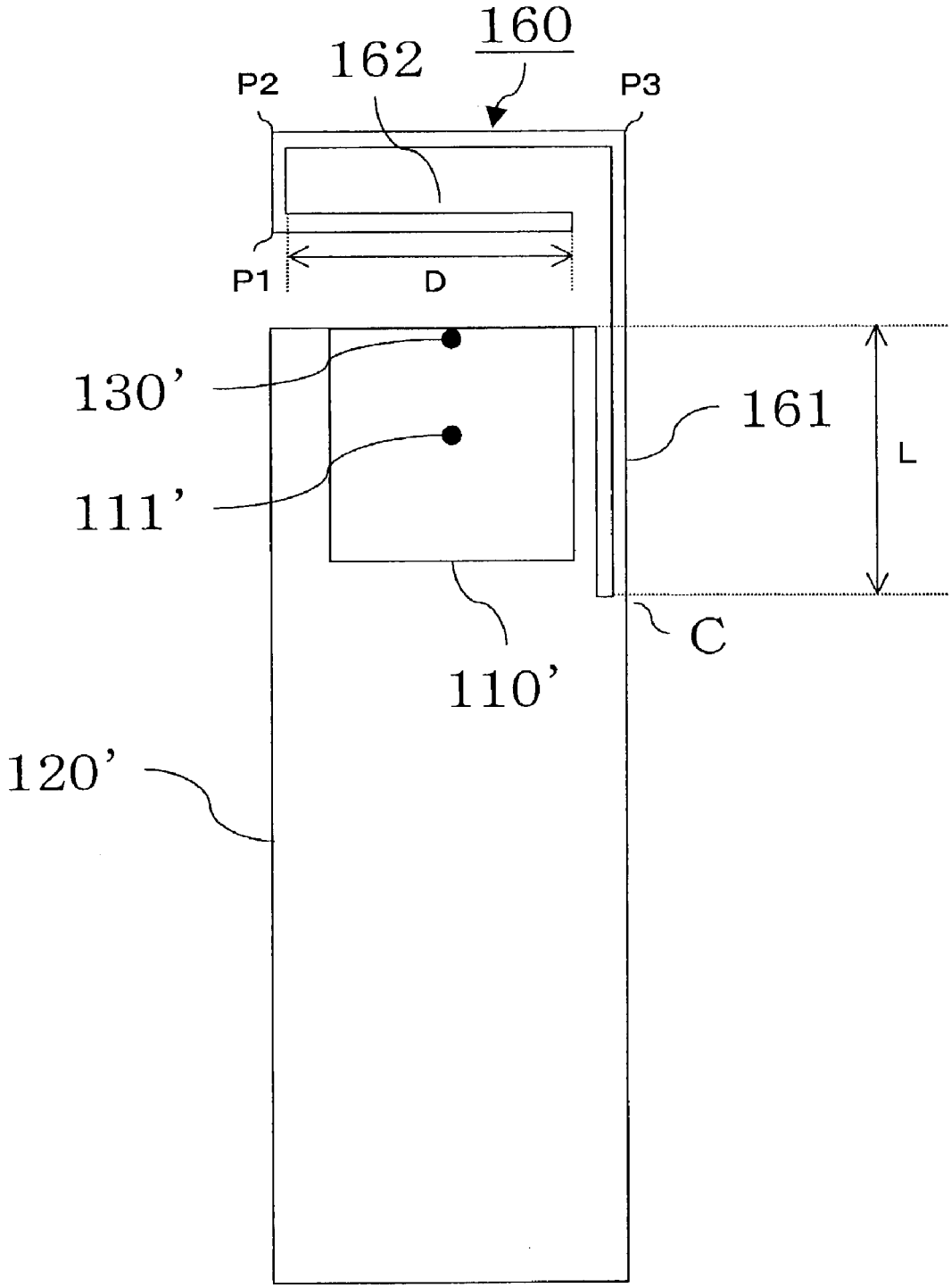
FIG. 7 is a plan view of the inverted F antenna of Embodiment 3 of the present invention.

Now, with reference to FIG. 7, a plan view of an inverted F antenna of Embodiment 3 of the present invention, description will be given of a configuration and operation of the inverted F antenna of the present embodiment.

The inverted F antenna of the present embodiment comprises an antenna element 110' having a feeding pin 111', a ground plate 120' arranged opposite the antenna element 110', a short circuit pin 130' that electrically connects the antenna element 110' and the ground plate 120' together, and a ground wire 160 connected to the ground plate 120' at a predetermined position C and having a generally spiral shape with a bent portion.

The antenna element 110' corresponds to an antenna element of the present invention. The feeding pin 111' corresponds to a feeding section of the present invention. The ground plate 120' corresponds to a ground plate of the present invention. The short circuit pin 130' corresponds to a short circuit section of the present invention. The ground wire 160 corresponds to a ground wire of the present invention.

The inverted F antenna of the present embodiment thus has a configuration similar to that of the inverted F antenna of Embodiment 2, described previously (see FIGS. 4 and 5), but is characterized in that the ground wire 160 has a foot portion 161 extending along the long sides of the ground plate 120' and connected to the ground plate 120' at the predetermined position C, corresponding to the middle of one of the long sides of the ground plate 120', and has the generally spiral shape with the bent portion the width of which is as large as that of the ground plate 120' on its short side and which is formed outside that short sides of the ground plate 120' which is located under the antenna element 110'.

Now, further detailed description will be given of the generally spiral shape with the bent portion according to the present embodiment.

The ground wire 160 has bending points P1 to P3 each bent at a right angle. A tip portion 162 corresponding to the portion between the tip of the ground wire 160 and the bending point P1 has a length D. The foot portion 161, i.e. the portion between the predetermined position C, corresponding to the root of the ground wire 160, and the corresponding short side of the ground plate 120' has a length L.

By changing the length D of the tip portion 162 of the ground wire 160 and the length L of the foot portion 161, the overall length of the ground wire 160 and the predetermined position C can be adjusted to make the resonant frequency of the ground plate 120' closer to that of the antenna element 110' (of course, the resonant frequency of the antenna element 110' may further be adjusted by forming a slit described later (see FIG. 11)). That is, electromagnetic coupling of the ground plate 120' and the antenna element 110' is controlled to enable the parallel resonance therebetween to be generated.

Employing a method of designing such an antenna apparatus enables implementation of an antenna apparatus with excellent characteristics such as the one described above.

If (1) the length of the ground plate 120' is large and about $\lambda/2$, i.e. half of a wavelength $\lambda$ in an operating frequency band (the case in which the antenna apparatus is incorporated in a folding cellular phone such as the one described above) or (2) conversely, it is small and less than $\lambda/4$, then it is particularly effective to adjust the overall length of the ground wire 160 and the predetermined position C to equivalently increase or reduce the size of the ground plate 120'. Of course, this also applies to Embodiments 1 and 2, described previously.

(Embodiment 4)

Now, with reference to FIGS. 8(*a*) and 8(*b*), a plan view and side view, respectively, of an inverted F antenna of Embodiment 4 of the present invention, description will be given of a configuration and operation of the inverted F antenna of the present embodiment.

The inverted F antenna of the present embodiment comprises the antenna element 110' having the feeding pin 111', the ground plate 120' arranged opposite the antenna element 110', the short circuit pin 130' that electrically connects the antenna element 110' and the ground plate 120' together, and a ground wire 170 connected to the ground plate 120' at a predetermined position and having a bent shape.

The ground wire 170 corresponds to a ground wire of the present invention.

Figure 8B:
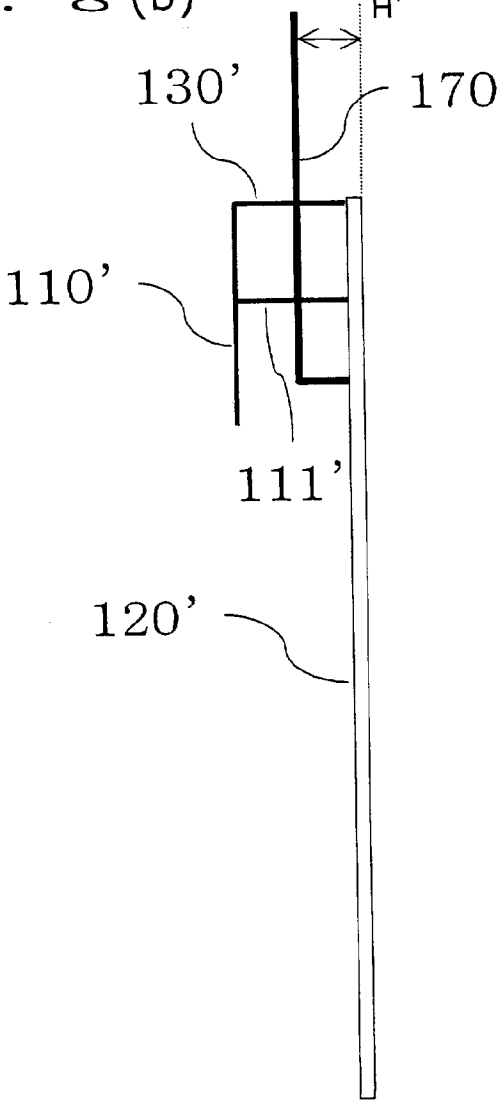
FIG. 8(*a*) is a plan view of an inverted F antenna of Embodiment 4 of the present invention, and FIG. 8(*b*) is a side view of the inverted F antenna of Embodiment 4 of the present invention.
Figure 8A:
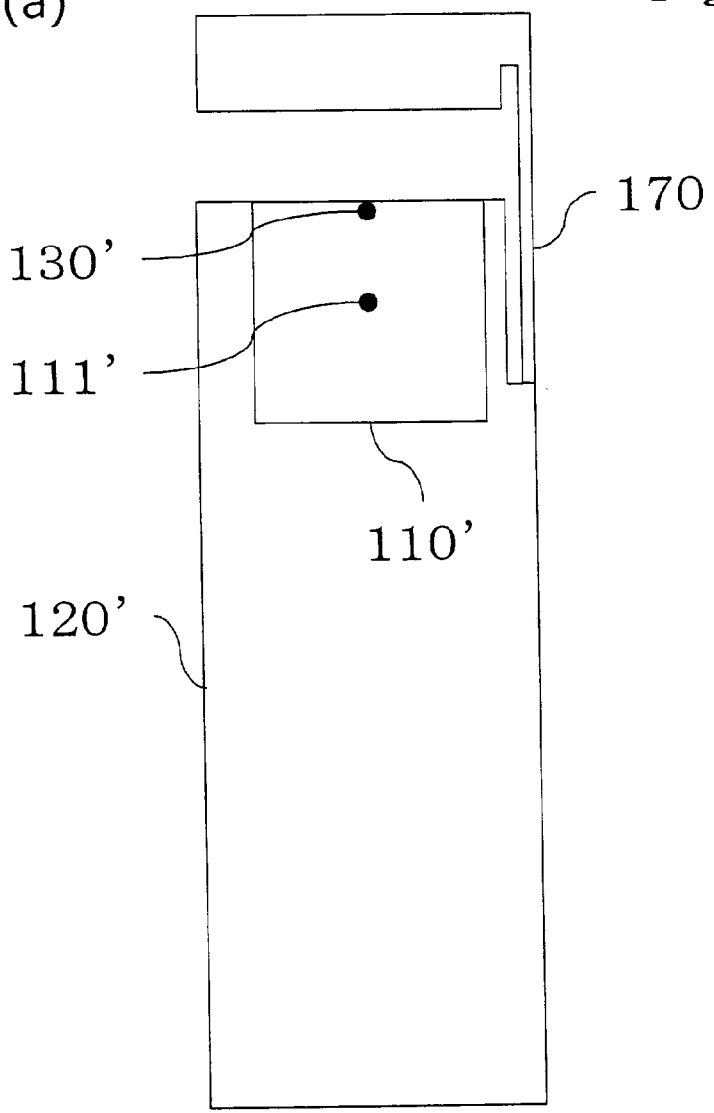

The inverted F antenna of the present embodiment thus has a configuration similar to that of the inverted F antenna of Embodiment 3, described previously (see FIG. 7), but is characterized in that the ground wire 170 is located in a plane different from the one in which the ground plate 120' is located (see FIG. 8(*b*)) (in Embodiments 1 to 3, described previously, the ground wire is located in the same plane in which the ground plate is located).

If the inverted F antenna of the present embodiment is incorporated in a cellular phone, a display is arranged opposite the antenna element 110' relative to the ground plate 120'. The location at which the display is arranged is close to a human body when the user talks over the cellular phone. Accordingly, a height H' (see FIG. 8(*b*)) from the ground plate 120' is provided to reduce the adverse effects of the human body on the antenna element 110' (for example, the degradation of its characteristics attributed to a change in current distribution resulting from the abutment of the antenna element against the user's head or ear). This suppresses a decrease in antenna gain and an increase in SAR (Specific Absorption Rate). Of course, providing the height H' (see FIG. 8(*b*)) also reduces the adverse effects of the antenna element 110' on the human body (for example, the physiologically adverse effects of strong fields).

In the present embodiment, the ground wire 170 is located in the plane parallel with the ground plate 120'. However, the present invention is not limited to this aspect. The ground wire 170 has only to be at least partly located in a plane different from the one in which the ground plate 120' is located. More specifically, the ground wire 170 may be located in a plane tilted so as not to be parallel with the ground plate 120' In short, the ground wire has only to be arranged so that an area in which electric fields from the ground wire are densely distributed (that is, an area in which the ground wire is electromagnetically coupled to the human body) lies away from the human body.

(Embodiment 5)

Figure 9:
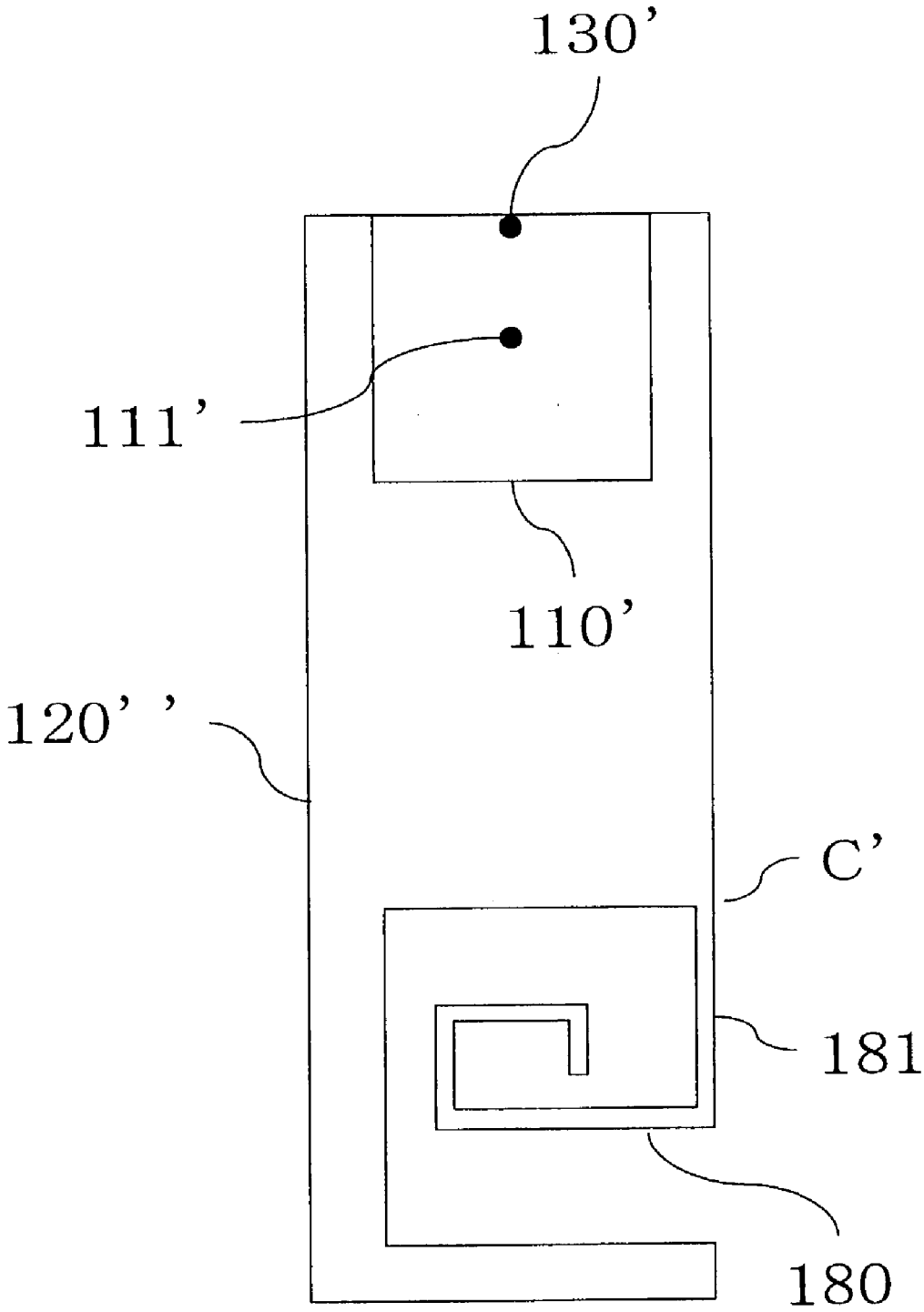
FIG. 9 is a plan view of the inverted F antenna of Embodiment 5 of the present invention.

Now, with reference to FIG. 9, a plan view of an inverted F antenna of Embodiment 5 of the present invention, description will be given of a configuration and operation of the inverted F antenna of the present embodiment.

The inverted F antenna of the present embodiment comprises the antenna element 110' having the feeding pin 111', a ground plate 120" arranged opposite the antenna element 110', the short circuit pin 130' that electrically connects the antenna element 110' and the ground plate 120" together, and a ground wire 180 connected to the ground plate 120" at a predetermined position C' and having a generally spiral shape with a bent portion.

The ground wire 180 corresponds to a ground wire of the present invention.

The inverted F antenna of the present embodiment thus has a configuration similar to that of the inverted F antenna of Embodiment 3, described previously (see FIG. 7), but is characterized in that the ground wire 180 has a foot portion 181 extending along the long sides of the ground plate 120" and connected to the ground plate 120" at the predetermined position C', corresponding to the middle of one of the long sides of the ground plate 120", and has the generally spiral shape with the bent portion the width of which is equal to or smaller than that of the ground plate 120" on its short side and which is formed inside that short side of the ground plate 120" which is located under the antenna element 110' (in Embodiment 3, described previously, the ground wire 160 is formed outside that short side of the ground plate which is located under the antenna element 110').

If the inverted F antenna of the present embodiment is incorporated in a cellular phone, the outside of that short side of the ground plate which is located under the antenna element 110' lies close to the human body when the user talks over the cellular phone. Thus, the ground wire 180 is arranged inside the short side, and the length of the ground wire is adjusted (for example, in view of a change in current distribution caused by holding with the fingers) so that the peak point of a current flowing through the ground wire can be separated from the human body. This suppresses a decrease in antenna gain and an increase in SAR as in the case with Embodiment 4, described previously.

Embodiments 1 to 5 have been described above in detail.

In the above described embodiments, the one ground wire is provided according to the present invention. However, the present invention is not limited to this aspect. According to the present invention, two ground wires, e.g. the ground wire 170 (FIGS. 8(*a*) and 8(*b*)) and the ground wire 180 (FIG. 9) may be provided. In short, according to the present invention, one or more ground wires may be provided. By associating the ground wires with respective predetermined operating frequencies, the ground plate is resonated at resonant frequencies corresponding to the plurality of ground wires. Accordingly, this antenna apparatus can be implemented in a cellular phone compatible with a dual or triple band to actualize wide-band characteristics.

In the above described embodiments, the ground wire of the present invention is constructed as a member integrated with the ground plate. However, the present invention is not limited to this aspect. The ground wire of the present invention may be constructed as a member different from the ground plate, using a separate part. For example, connectable connection terminals are provided at the predetermined position C (see FIG. 7) of the ground plate 120' and the terminal position of the foot portion 161 (see FIG. 7) of the ground wire 160. Then, the length of the ground wire and the position at which the ground wire is connected can be adjusted easily even if the ground plate 120' is composed of a metal chassis, an LCD holder, a substrate, or the like. Further, (1) the ground wire can be stuck to an inner wall portion of an enclosure of the cellular phone, or (2) it can be formed as a GND pattern on a flexible substrate. This increases the degree of freedom for design and reduces variations in characteristics associated with mass production.

Figure 10:
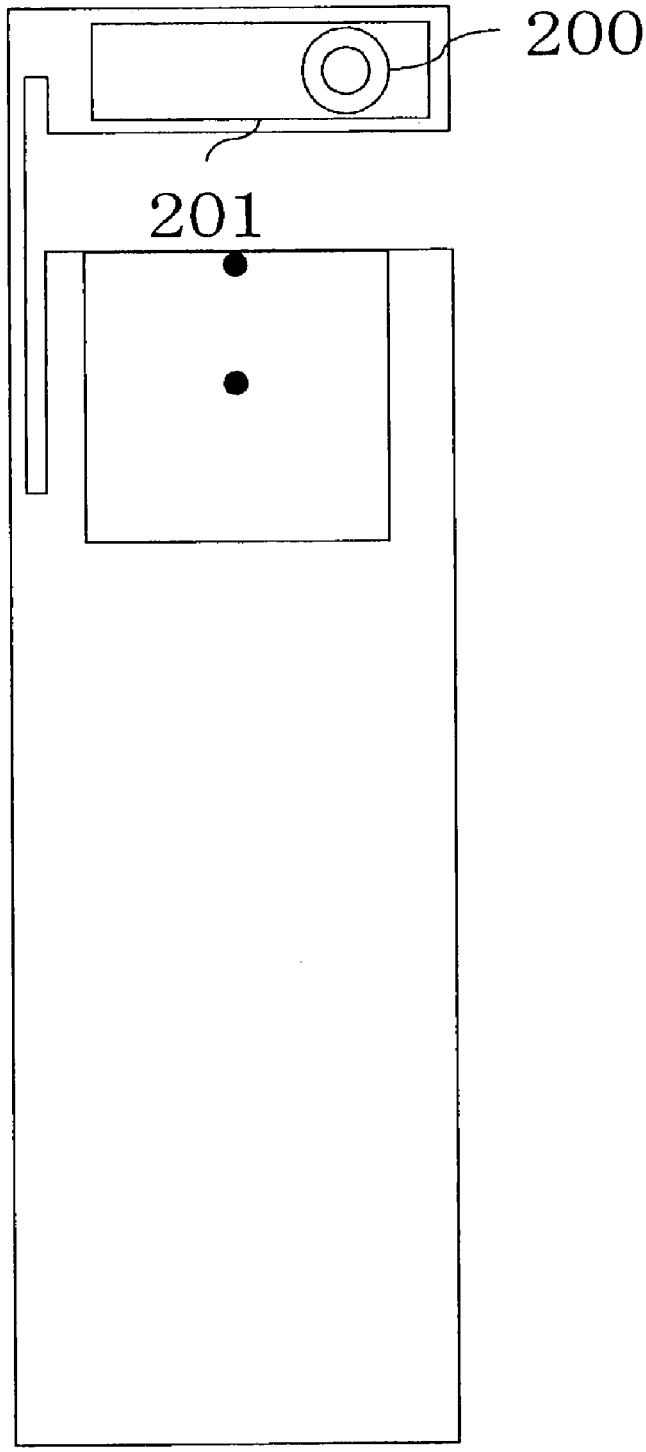
FIG. 10 is a plan view of an inverted F antenna in which a ground wire is also used as a ground electrode according to the present invention.
Figure 17:
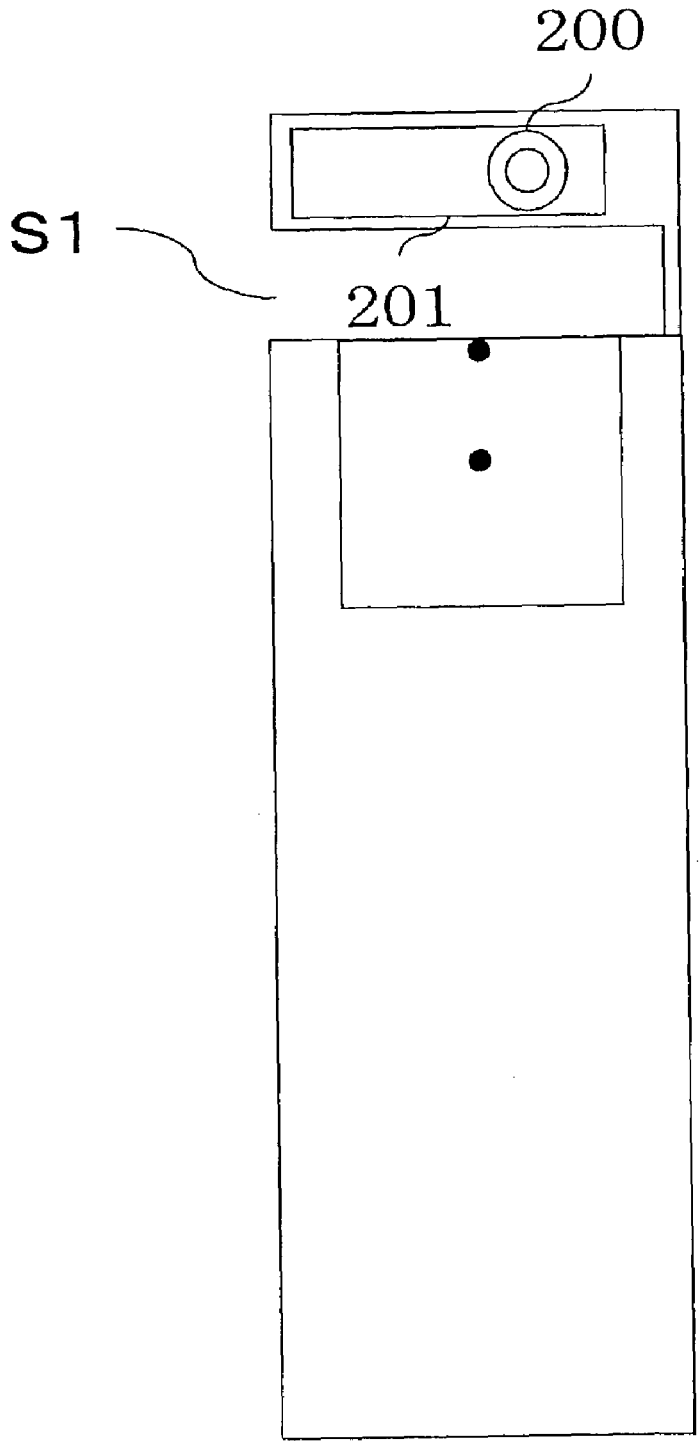
FIG. 17 is a plan view of an inverted F antenna that utilizes a structure with a horizontal slit S1 to use a ground wire also as a ground electrode.
Figure 18:
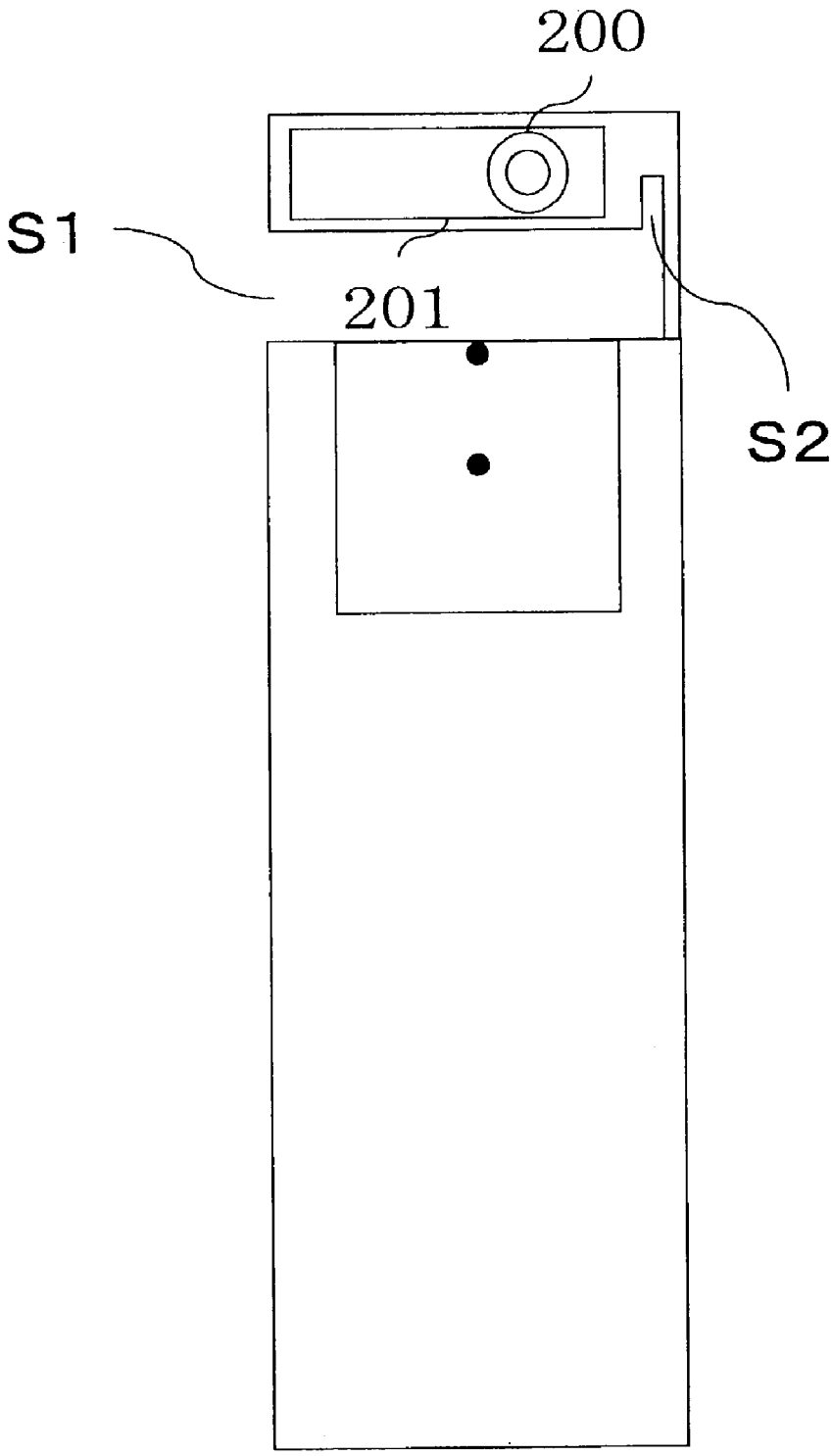
FIG. 18 is a plan view of an inverted F antenna that utilizes a structure with the horizontal slit S1 and a slit S2 formed in a ground wire to use the ground wire also as a ground electrode.
Figure 19:
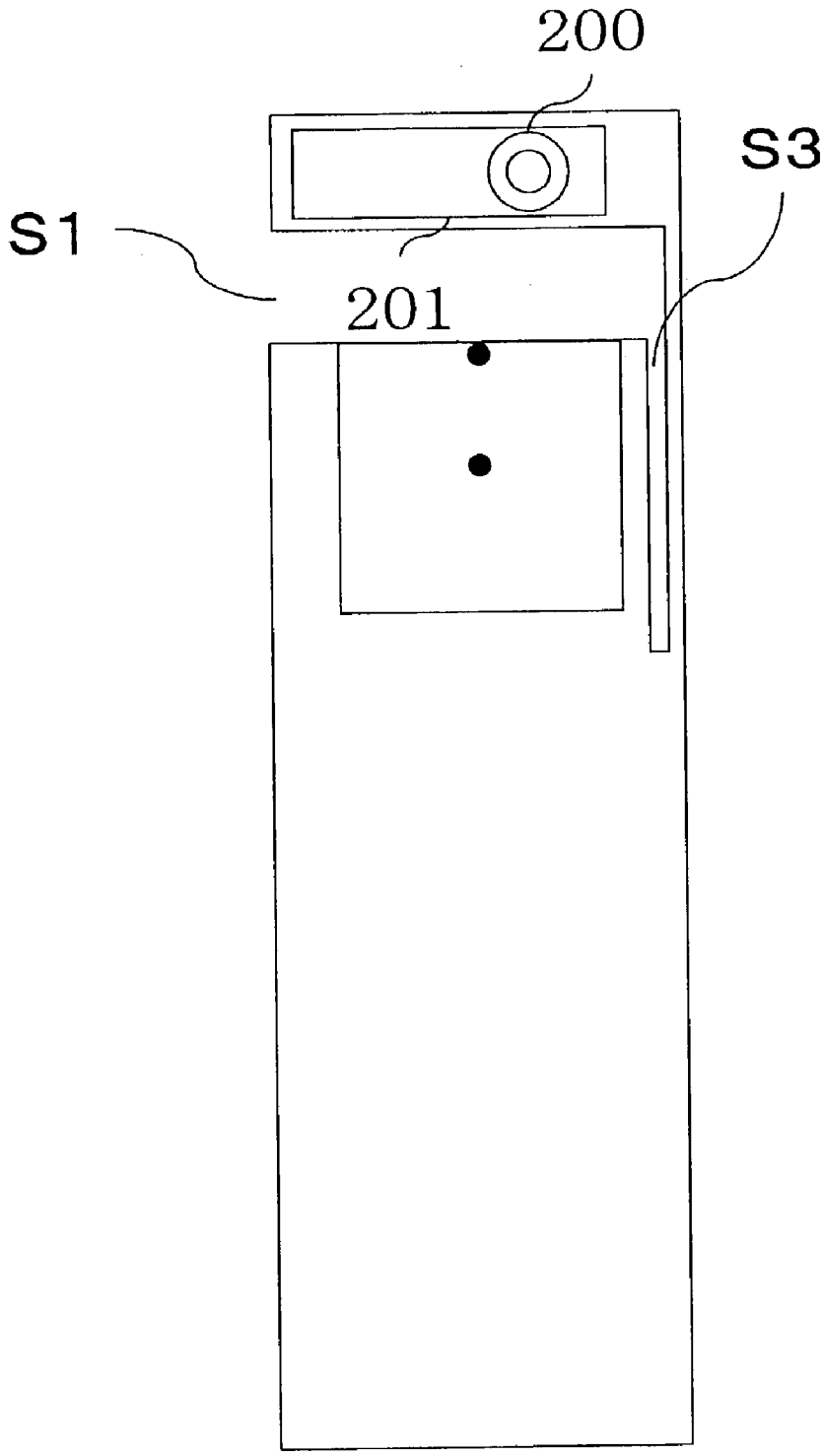
FIG. 19 is a plan view of an inverted F antenna that utilizes a structure with the horizontal slit S1 and a slit S3 formed in a ground plate to use the ground wire also as a ground electrode.

Alternatively, the ground wire of the present invention may also be used as a ground electrode (GND) For example, (1) as shown in FIG. 10, a plan view of an inverted F antenna in which a ground wire is also used as a ground electrode, the ground wire may also be used as a GND of a camera substrate 201 on which a camera 200 is mounted. Alternatively, (2) the ground wire may also be used as a GND of a receiver or an audio speaker. Using the ground wire also as a ground electrode enables the number of parts required to be reduced. Of course, the ground wire can also be used as a ground electrode by using a structure provided with a horizontal slit S1 as shown in FIG. 17, a structure provided with the horizontal slit S1 and a slit S2 formed in the ground wire as shown in FIG. 18, or a structure provided with the horizontal slit S1 and a slit S3 formed in the ground plate as shown in FIG. 19. FIG. 17 is a plan view of an inverted F antenna in which the ground wire can also be used as a ground electrode by using the structure provided with the horizontal slit S1 according to the present invention. FIG. 18 is a plan view of an inverted F antenna in which the ground wire can also be used as a ground electrode by using the structure provided with the horizontal slit S1 and the slit S2 formed in the ground wire according to the present invention. FIG. 19 is a plan view of an inverted F antenna in which the ground wire can also be used as a ground electrode by using the structure provided with the horizontal slit S1 and the slit S3 formed in the ground plate according to the present invention.

Figure 20B:
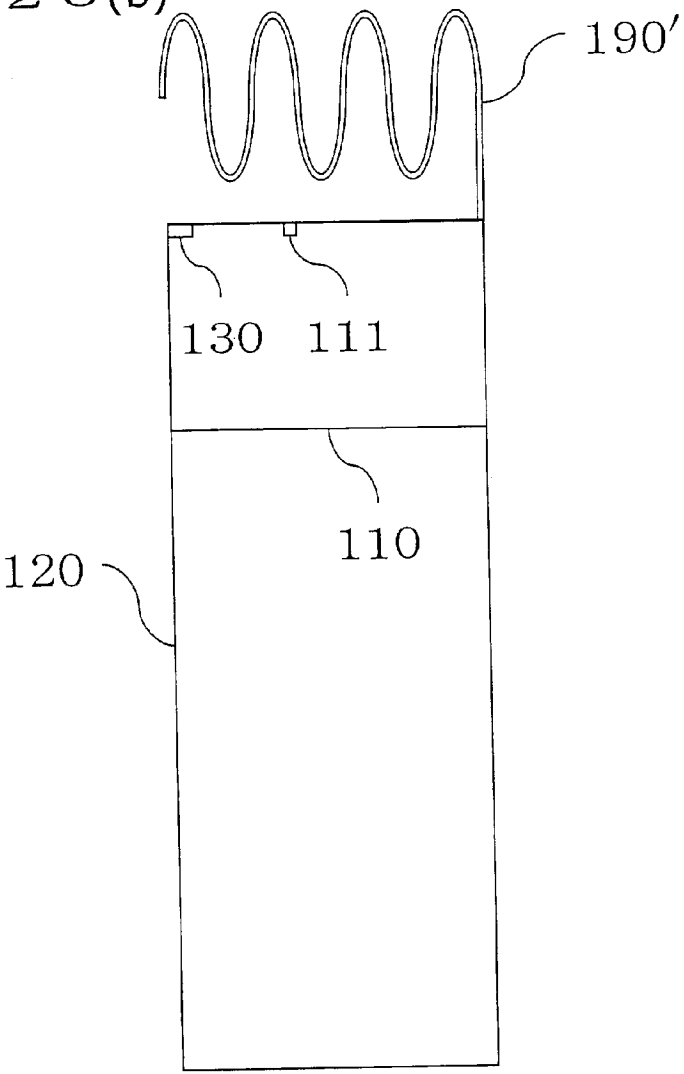
FIG. 20(*a*) is a plan view of an inverted F antenna in which a ground wire 190 has a shape with a bent portion, and FIG. 20(*b*) is a plan view of an inverted F antenna in which a ground wire 190' has a shape with a bent portion.
Figure 20A:
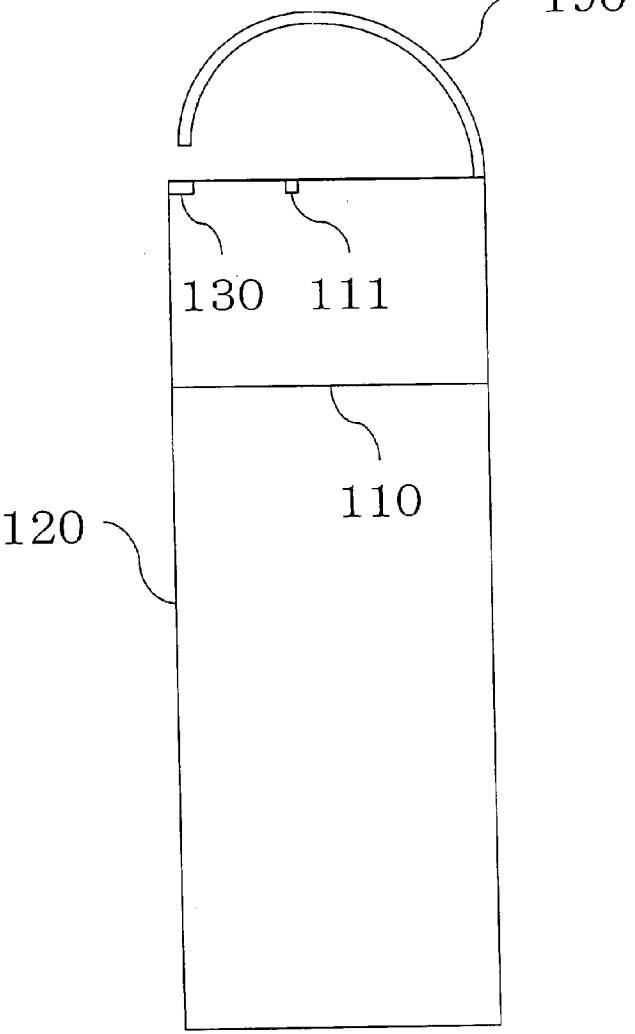
Figure 25:
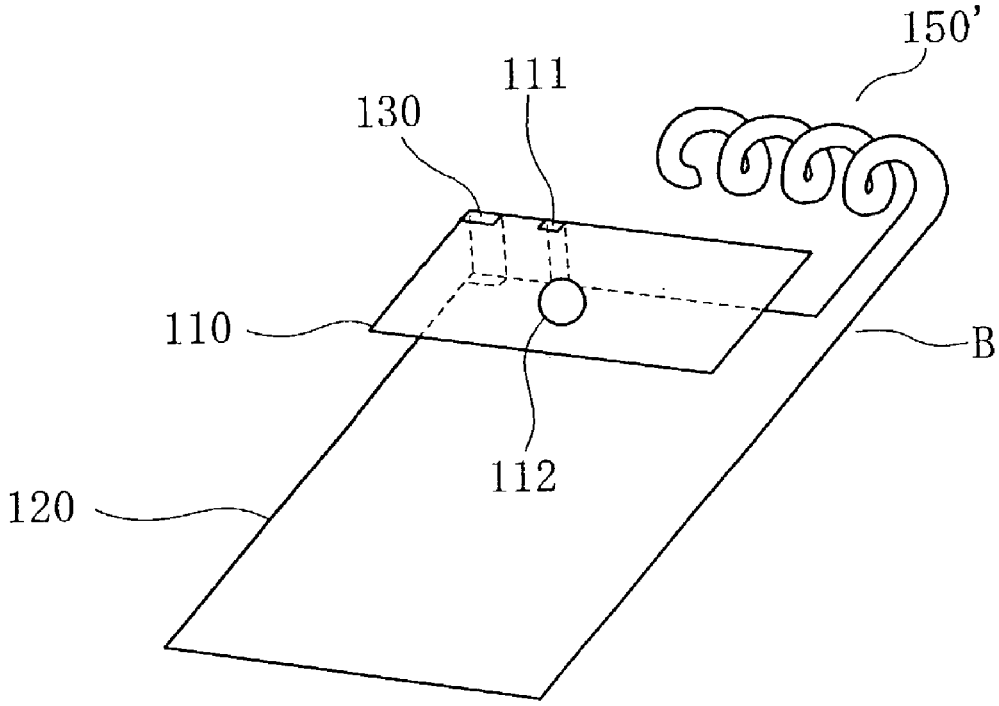
FIG. 25 is a perspective view of an inverted F antenna in which a ground wire 150' has a helical shape.

Further, in the above described present embodiments, the ground wire of the present invention has the linear shape or the shape with the bent portion. However, the present invention is not limited to this aspect. The ground wire of the present invention may have a shape with one or more curves. For example, as shown in FIG. 20(*a*), a plan view of an inverted F antenna in which a ground wire 190 according to the present invention has a shape with curves and in FIG. 20(*b*), a plan view of an inverted F antenna in which a ground wire 190' according to the preset invention has a shape with curves, the ground wires 190 and 190' in an antenna apparatus having a configuration similar to that of the antenna apparatus of Embodiment 1 may be curved. This enables the ground wire to be housed easily in a limited space to improve the degree of freedom for design. Alternatively, the ground wire of the present invention may have a helical or another shape which cannot be contained in any planes. For example, as shown in FIG. 25, a perspective view of an inverted F antenna in which a ground wire 150' according to the present invention has a helical shape, the ground wire 150' in an antenna apparatus having a configuration similar to that of the antenna apparatus of Embodiment 2 may have a helical shape. This reduces the physical volume occupied by the ground wire to improve the degree of freedom for design.

Figure 21:
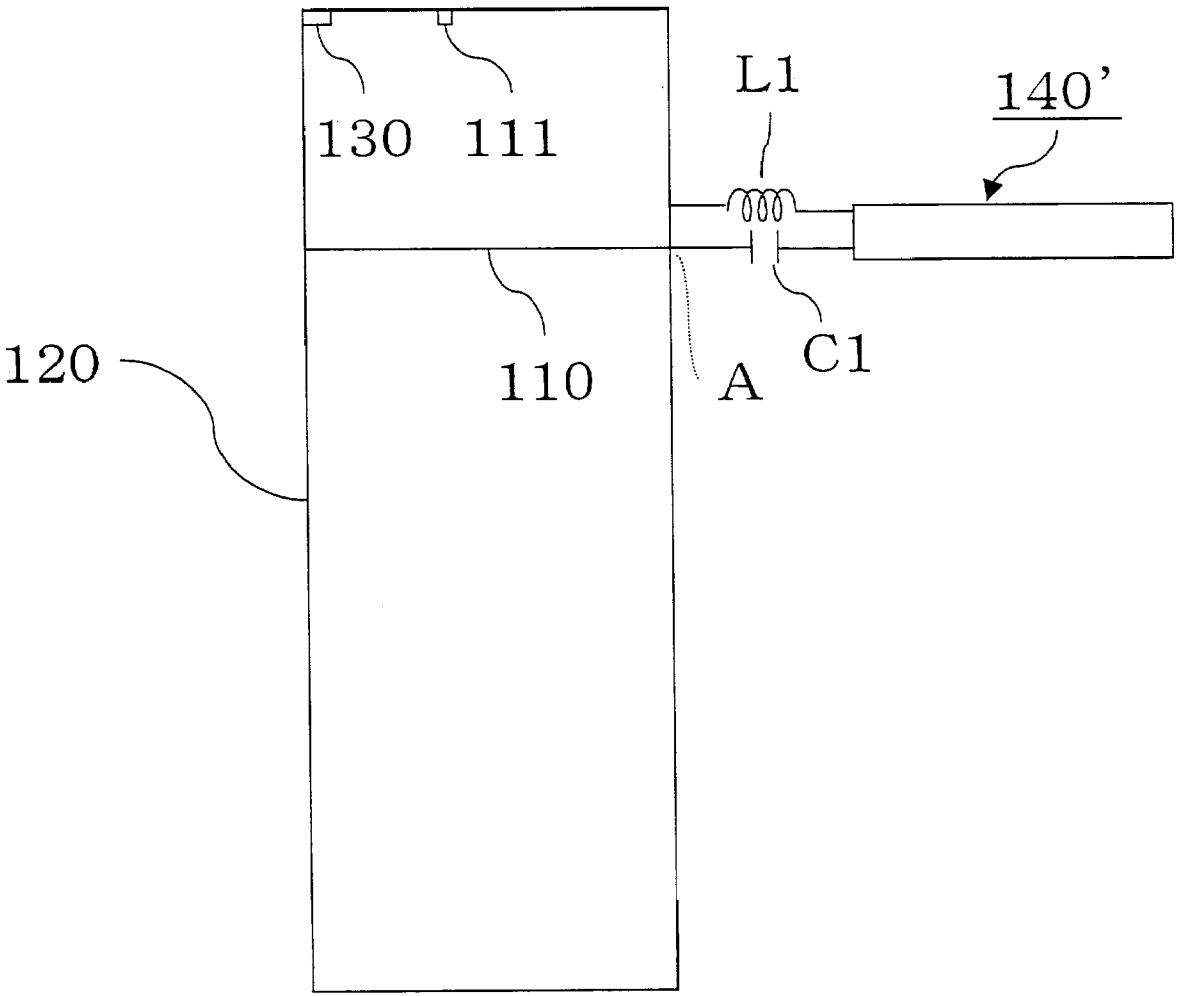
FIG. 21 is a plan view of an inverted F antenna in which a ground wire 140' partly has a coil L1 and a capacitor C1.
Figure 24:
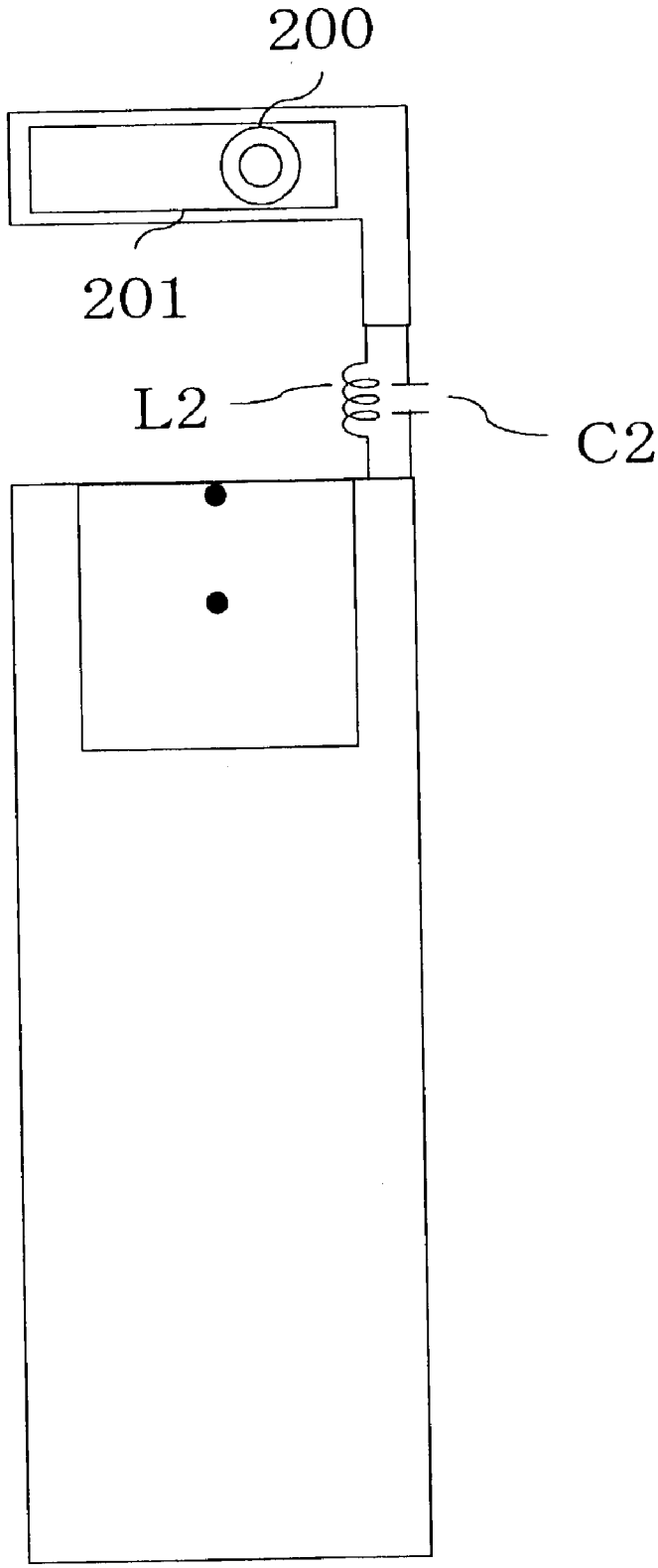
FIG. 24 is a plan view of an inverted F antenna in which a ground wire partly has a coil L2 and a capacitor C2.

Further, the ground wire of the present invention may partly have a coil and/or a capacitor. For example, (1) as shown in FIG. 21, a plan view of an inverted F antenna in which a ground wire 140' according to the present invention partly has a coil L1 and a capacitor C1, the electric characteristics of the ground plate may be changed by partly forming the ground wire 140' as the coil L1 and the capacitor C1, the ground wire 140' being included in an antenna apparatus having a configuration similar to that of the antenna apparatus of Embodiment 1. Alternatively, (2) as shown in FIG. 24, a plan view of an inverted F antenna in which the ground wire according to the present invention partly has a coil L2 and a capacitor C2, the electric characteristics of the ground plate may be changed by partly forming the ground wire as the coil L2 and the capacitor C2, the ground wire being included in an antenna apparatus having a configuration similar to that of the antenna apparatus of the present embodiment (see FIG. 17). This enables the electric length of the ground wire to be changed by changing the inductance of the coil or the capacitance of the capacitor. Consequently, these configurations improve the degree of freedom for design (Originally, the length of the ground wire is adjusted to adjust the electric length of the ground plate. However, even if the length of the ground wire deviates from its optimal dimension during mass production or for another reason, this deviation can be corrected using the coil or the capacitor).

Further, the entire ground wire of the present invention may be opposite the antenna element or may avoid being opposite the antenna element. Alternatively, at least part of the ground wire of the present invention may avoid being opposite the antenna element.

Figure 11:
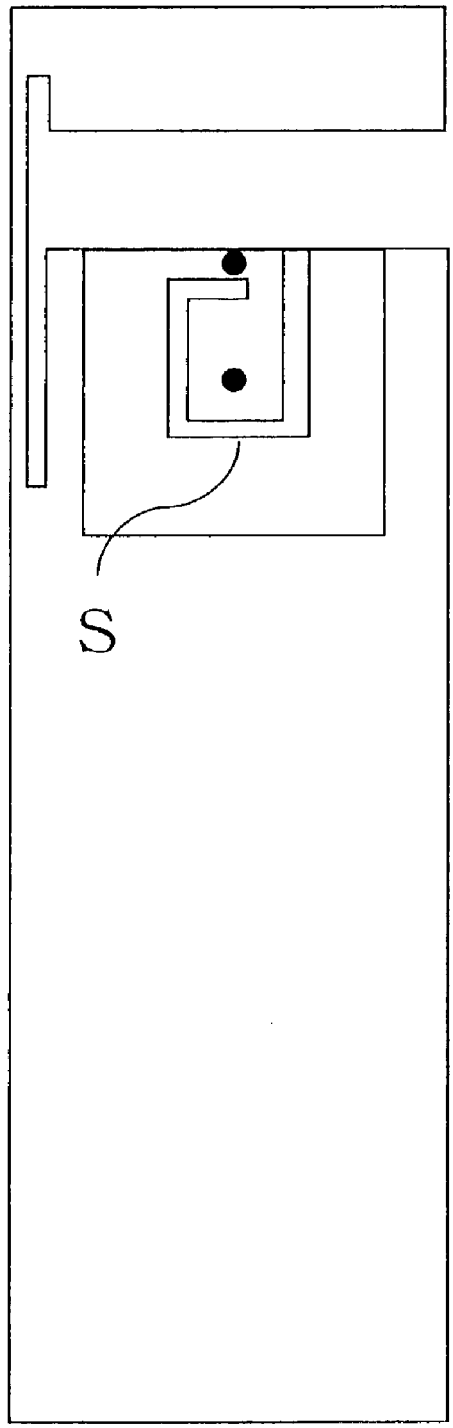
FIG. 11 is a plan view of an inverted F antenna in which an antenna element has a predetermined slit S.

Furthermore, the antenna element of the present invention may have a predetermined slit. For example, as shown in FIG. 11, a plan view of an inverted F antenna in which an antenna element according to the present invention has a predetermined slit S, the slit S may be formed in the antenna element. By forming a slit to provide a plurality of types of paths on the antenna element, the ground plate is resonated at resonant frequencies corresponding to the respective paths. This serves to actualize wide-band characteristics.

Figure 12:
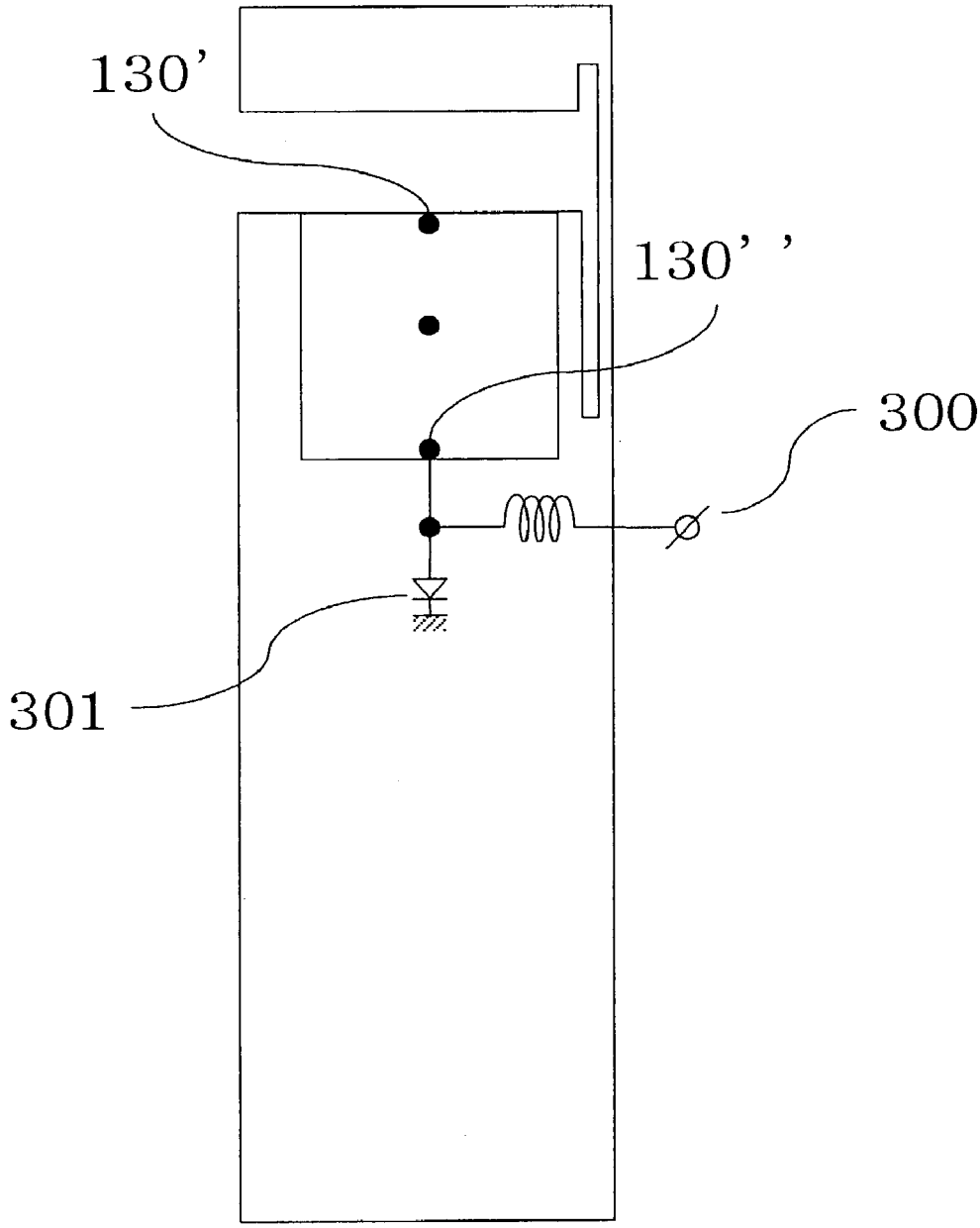
FIG. 12 is a plan view of an inverted F antenna in which a short circuit section has a plurality of short circuit pins and a switch circuit used to carry out switching to one of the pins which is to be used.

Moreover, the short circuit section of the present invention may have a plurality of short circuit pins corresponding to respective predetermined operating frequencies and a switch circuit used to carry out switching to one of the plurality of short circuit pins which is to be used. For example, as shown in FIG. 12, a plan view of an inverted F antenna in which a short circuit section according to the present invention has a plurality of short circuit pins and a switch circuit used to carry out switching to one of the short circuit pins which is to be used, a short circuit pin 130" may be provided in addition to the short circuit pin 130' so as to switch the conductivity of a diode 301 in such a manner that an on-off switch circuit 300 is off while low frequency is used and is on while high frequency is used. This allows the antenna element to resonate at resonant frequencies corresponding to the respective short circuit pins. Accordingly, this antenna apparatus can be implemented in a cellular phone compatible with a dual or triple band to actualize wide-band characteristics. Of course, the plurality of short circuit pins may be selected so as to ensure communication at more important frequencies.

Figure 22:
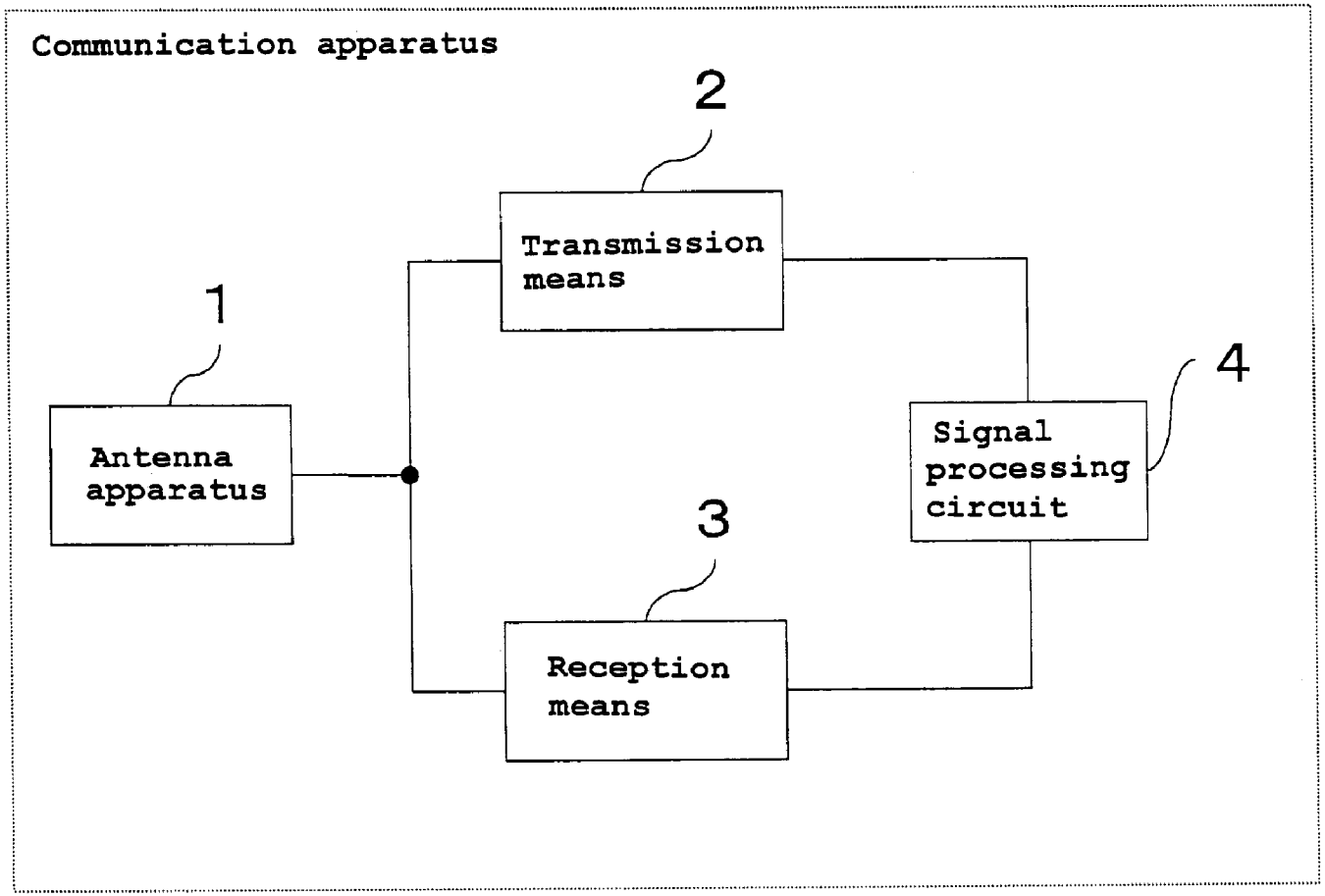
FIG. 22 is a diagram showing a communication apparatus of one embodiment of the present invention.

The present invention includes a communication apparatus such as the one shown in FIG. 22 showing a configuration of a communication apparatus of one embodiment of the present invention. This communication apparatus comprises an antenna apparatus 1 according to an embodiment of the present invention, transmission means 2 of transmitting electric wave signals using the antenna apparatus 1, a reception means 3 of receiving electric wave signals using the antenna apparatus 1, and a signal processing circuit 4 used to carry out signal processing so as to allow electric wave signals to be transmitted and received.

Figure 23B:
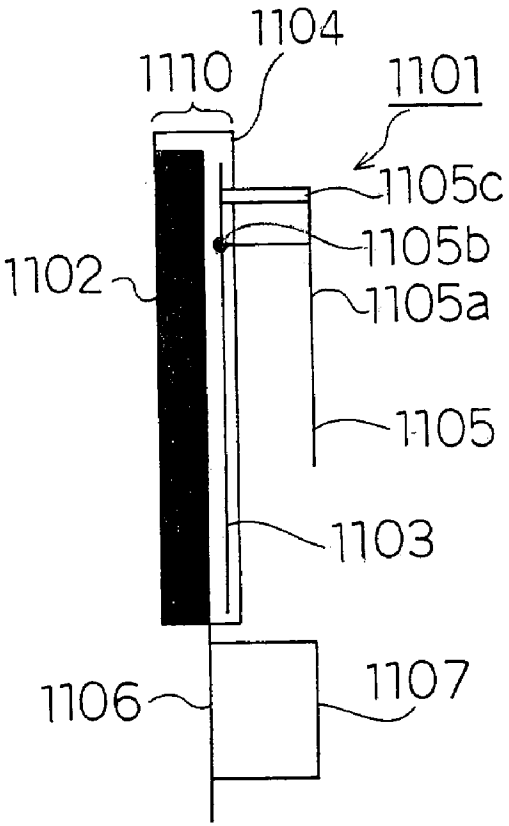
FIG. 23(*a*) is a plan view of the communication apparatus of the embodiment of the present invention shown in FIG. 22, and FIG. 23 (*b*) is a side view of the communication apparatus of the embodiment of the present invention.
Figure 23A:
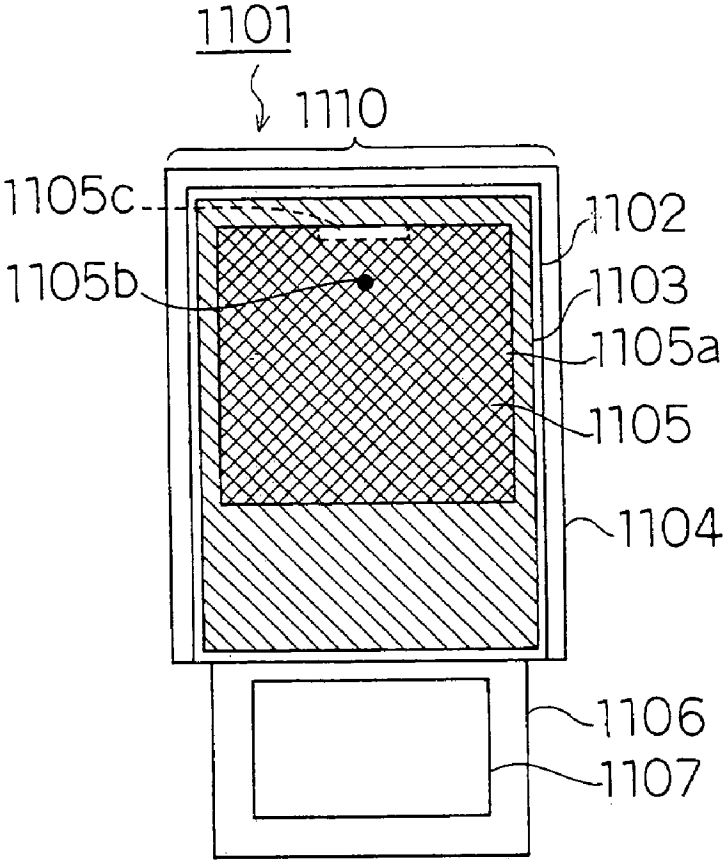

Specifically, the communication apparatus of this embodiment of the present invention is constructed, for example, as shown in FIG. 23(*a*), a plan view of this communication apparatus and FIG. 23(*b*), its side view.

That is, an antenna and liquid crystal module 1101 comprises a liquid crystal display 1110, a built-in antenna 1105 provided on the back surface of the liquid crystal display 1110 and utilizing the antenna apparatus of an embodiment of the present invention, a substrate 1106 provided on the bottom surface of the liquid crystal display 1110, and a driver circuit 1107 provided on the back surface of the substrate 1106. The liquid crystal display 1110 is composed of a display main body 1102, a metal reflecting plate 1103 provided on the back surface of an image display surface of the display main body 1102, and a frame 1104 which houses the display main body 1102 and the reflecting plate 1103 and which is composed of a U-shaped non-conductive member. The liquid crystal display 1110 is driven by a driver circuit 1107 to display an image on the image display surface of the display main body 1102. The end of an antenna element section 1105*a* on the rectangular plate is electrically connected to the reflecting plate 1103 via a metal connection section 1105*c*. The antenna element section 1105*a* is operated by electricity fed from a feeding point 1105*b* on the reflecting plate 1103 which is provided in a plane opposite to the display main body 1102 and the reflecting plate 1103. Inputs to and outputs from the feeding point 1105*b* are supplied by the transmission and reception means (not shown) on the substrate 1106. In the antenna and liquid crystal module 1101, the antenna element section 1105*a* is provided directly on the back surface of the liquid crystal display 1110. Further, the reflecting plate 1103 and the antenna element section 1105*a* are connected together via the connection section 1105*c*. Consequently, the reflecting plate 1103 functions as a ground plate for the antenna element section 1105*a*.

Figure 26:
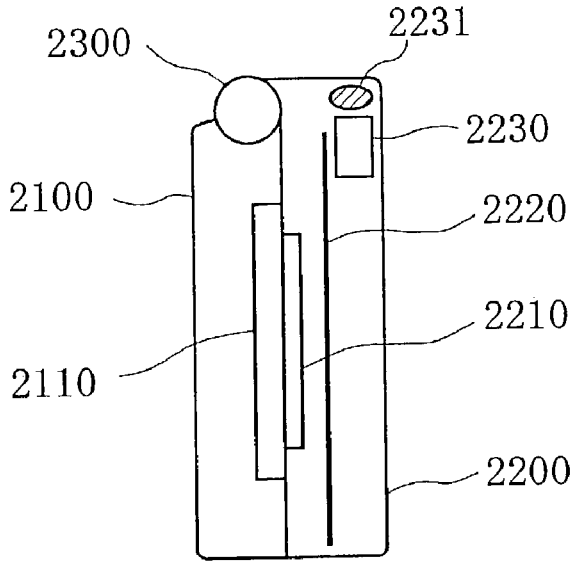
FIG. 26 is a side view of a folding cellular phone (1) according to an embodiment of a communication apparatus of the present invention.
Figure 27:
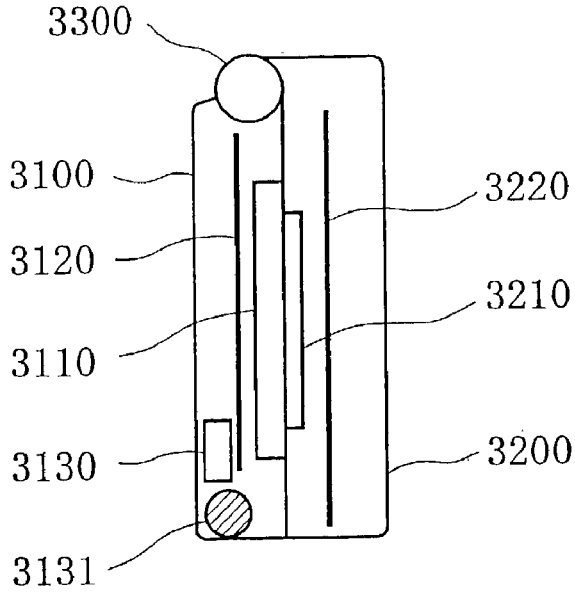
FIG. 27 is a side view of a folding cellular phone (2) according to an embodiment of a communication apparatus of the present invention.

A more specific example of the communication apparatus of the present invention is a folding cellular phone in which an inverted F antenna of any of the present embodiments described above is housed in an upper or lower enclosure. For example, a specific example of a communication apparatus according to the present invention is a folding cellular phone such as the one shown in FIG. 26, a side view of a folding cellular phone (1) as an embodiment of the communication apparatus of the present invention. This cellular phone comprises an upper enclosure 2100 that houses a display 2110; a lower enclosure 2200 that houses a key section 2210, a lower substrate 2220, and an inverted F antenna 2230 constructed similarly to the inverted F antenna of Embodiment 2, described above (see FIG. 4), and having a ground wire 2231 (schematically illustrated); and a metal hinge section 2300 that joins the upper enclosure 2100 and the lower enclosure 2200 together. Another specific example of a communication apparatus according to the present invention is a folding cellular phone such as the one shown in FIG. 27, a side view of a folding cellular phone (2) as an embodiment of the communication apparatus of the present invention. This cellular phone comprises an upper enclosure 3100 that houses a display 3110, an upper substrate 3120, and an inverted F antenna 3130 constructed similarly to the inverted F antenna of Embodiment 2, described above (see FIG. 4), and having a ground wire 3131 (schematically illustrated); a lower enclosure 3200 that houses a key section 3210 and a lower substrate 3220; and a metal hinge section 3300 that joins the upper enclosure 3100 and the lower enclosure 3200 together. The lower enclosure 2200 corresponds to a first enclosure of the present invention. The upper enclosure 2100 corresponds to a second enclosure of the present invention. The metal hinge section 2300 corresponds to a hinge section of the present invention. The upper enclosure 3100 corresponds to a first enclosure of the present invention. The lower enclosure 3200 corresponds to a second enclosure of the present invention. The metal hinge section 3300 corresponds to a hinge section of the present invention.

Figure 28:
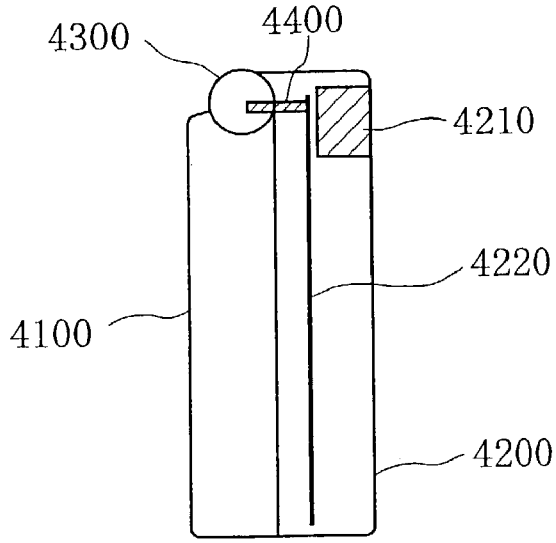
FIG. 28 is a side view of a folding cellular phone (3) according to an embodiment of a communication apparatus of the present invention.
Figure 29:
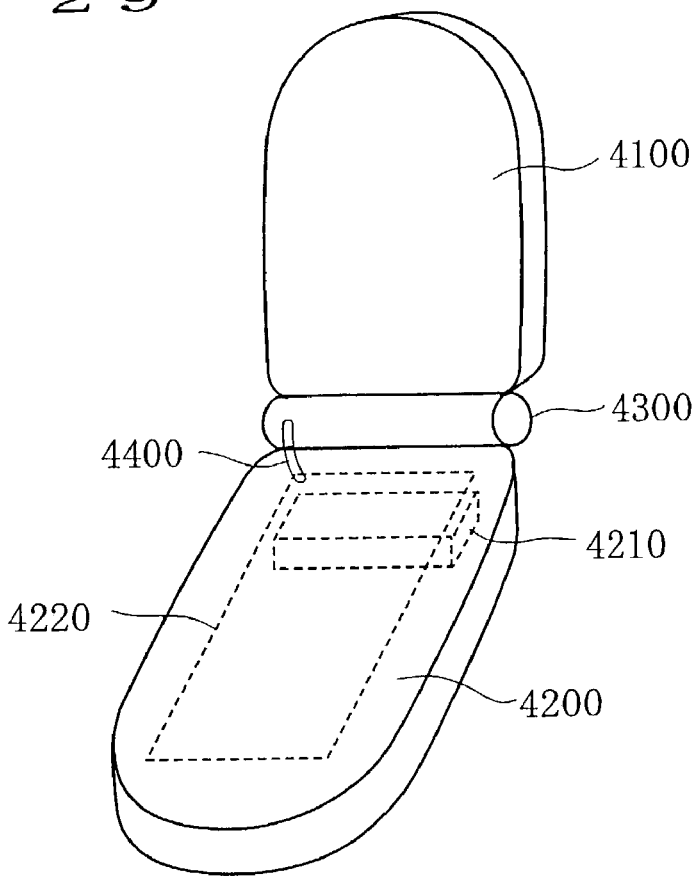
FIG. 29 is a perspective view of the folding cellular phone (3) according to the embodiment of a communication apparatus of the present invention.

Furthermore, for example, as shown in FIG. 28, a side view of a folding cellular phone (3) as an embodiment of the communication apparatus of the present invention and in FIG. 29, its perspective view, an inverted F antenna 4210 may be housed in a lower enclosure 4200, and an upper enclosure 4100 and the lower enclosure 4200 may be joined together via a metal hinge section 4300. Further, a GND of a lower substrate 4220 housed in the lower enclosure 4200 and the metal hinge section 4300 may be electrically connected together via a connection element 4400 at at least one point (As shown in FIG. 29, desirably, only one of the opposite ends of the metal hinge section 4300 is connected to the GND of the lower substrate 4220, with the other open. Of course, if the upper enclosure 4100 or the substrate housed in the upper enclosure 4100 is operated as a GND of the antenna, a GND of the upper enclosure 4100 or the substrate housed in the upper enclosure 4100 and the metal hinge section 4300 have to be electrically connected together at least one point). In this regard, the inverted F antenna 4210 corresponds to a predetermined antenna apparatus of the present invention. The lower substrate 4220 corresponds to a predetermined substrate of the present invention. The lower enclosure 4200 corresponds to a first enclosure of the present invention. The upper enclosure 4100 corresponds to a second enclosure of the present invention. The metal hinge section 4300 corresponds to a hinge section of the present invention. The above configuration allows the metal hinge section to function as a part of the ground wire. Accordingly, the inverted F antenna 4210 maybe a conventional inverted F antenna without ground wires. Of course, if the ground plate is to be resonated at a plurality of resonant frequencies, the inverted F antenna of any of the present embodiments described above may be used. In addition, the connection element 4400 and the metal hinge section 4300 need not be directly connected together but may be connected via capacitance. In short, this connection has only to be accomplished as an electric one in a high-frequency region.

In the above described present embodiments, the antenna apparatus of the present invention is the inverted F antenna. However, the present invention is not limited to this aspect. The antenna apparatus of the present invention may be of an unbalanced type. However, the inverted F antenna is desirably used in terms of a wider band and reduced size.

A first aspect of the present invention provides, for example, an inverted F antenna with its thickness reduced.

A second aspect of the present invention provides, for example, an inverted F antenna with its thickness further reduced.

A third aspect of the present invention provides, for example, an inverted F antenna with its thickness further reduced.

A fourth aspect of the present invention provides, for example, an inverted F antenna with a decrease in antenna gain and an increase in SAR suppressed.

A fifth aspect of the present invention provides, for example, an inverted F antenna that serves to lower the adverse effects of a human body or the adverse effects on it when the user talks over a cellular phone, and with a decrease in antenna gain and an increase in SR suppressed.

A sixth aspect of the present invention provides, for example, a cellular phone with the number of parts reduced.

A seventh aspect of the present invention provides, for example, a cellular phone which allows a GND of a receiver or an audio speaker to be shared and which requires a reduced number of parts.

An eighth aspect of the present invention provides, for example, an inverted F antenna which serves to improve the degree of freedom for design and which suppresses variations in characteristics associated with mass production.

A ninth aspect of the present invention provides, for example, a cellular phone which serves to improve the degree of freedom for design and which suppresses variations in characteristics associated with mass production.

A tenth aspect of the present invention provides, for example, an inverted F antenna with the degree of freedom for design improved.

An eleventh aspect of the present invention provides, for example, a cellular phone which is compatible with a dual or triple band and which has wide-band characteristics.

A twelfth aspect of the present invention provides, for example, an inverted F antenna with the degree of freedom for design improved.

A thirteenth aspect of the present invention provides, for example, an inverted F antenna with the degree of freedom for design improved.

A fourteenth aspect of the present invention provides, for example, an inverted F antenna with the degree of freedom for design further improved.

A fifteenth aspect of the present invention provides, for example, a cellular phone which is compatible with a dual or triple band and which has wide-band characteristics.

A sixteenth aspect of the present invention provides, for example, an inverted F antenna with a decrease in antenna gain and an increase in SAR suppressed.

A seventeenth aspect of the present invention provides, for example, a cellular phone with its thickness reduced and having wide-band characteristics.

An eighteenth aspect of the present invention provides, for example, a folding cellular phone with its thickness reduced and having wide-band characteristics.

A nineteenth aspect of the present invention provides, for example, a thin folding cellular phone.

A twentieth aspect of the present invention provides, for example, a thinner folding cellular phone.

A twenty-first aspect of the present invention provides, for example, an inverted F antenna designing method with the degree of freedom for design improved.

A twenty-second aspect of the present invention provides, for example, an inverted F antenna designing method with the degree of freedom for design further improved.

As is apparent from the above description, the present invention has the advantage of implementing, for example, a folding cellular phone with its thickness reduced.

What is claimed is:

1. A communication apparatus comprising:

an antenna apparatus;

a first enclosure that houses said antenna apparatus and a substrate having a single ground plate;

a second enclosure that is different from said first enclosure; and a hinge section that joins said first enclosure and said second enclosure together, wherein said single plate and said hinge section are electrically connected together such that only one end of said hinge section is connected to said single ground plate, with the other end not connected to anything, so as to allow said hinge section to function as a part of a ground wire.

2. The communication apparatus according to claim 1, wherein an electrical length of said single ground plate is less than $\lambda/4$.

3. The communication apparatus according to claim 1, wherein said hinge section is used as a ground of a camera substrate.

* * * * *